US011060233B2

(12) United States Patent
Im et al.

(10) Patent No.: US 11,060,233 B2
(45) Date of Patent: Jul. 13, 2021

(54) WASHING MACHINE AND METHOD FOR CONTROLLING THE SAME

(71) Applicant: LG ELECTRONICS INC., Seoul (KR)

(72) Inventors: Myunghun Im, Seoul (KR); Hwanjin Jung, Seoul (KR); Kyungchul Woo, Seoul (KR)

(73) Assignee: LG Electronics Inc., Seoul (KR)

( * ) Notice: Subject to any disclaimer, the term of this patent is extended or adjusted under 35 U.S.C. 154(b) by 297 days.

(21) Appl. No.: 16/361,896

(22) Filed: Mar. 22, 2019

(65) Prior Publication Data

US 2019/0292711 A1 Sep. 26, 2019

(30) Foreign Application Priority Data

Mar. 23, 2018 (KR) ..... 10-2018-0034033

(51) Int. Cl.

| | |
|---|---|
| ***D06F 39/06*** | (2006.01) |
| ***D06F 37/04*** | (2006.01) |
| ***D06F 37/30*** | (2020.01) |
| ***D06F 39/08*** | (2006.01) |
| ***D06F 35/00*** | (2006.01) |
| ***D06F 33/00*** | (2020.01) |
| ***D06F 34/18*** | (2020.01) |
| *D06F 39/14* | (2006.01) |
| *D06F 37/26* | (2006.01) |

(52) U.S. Cl.

CPC ..... *D06F 39/06* (2013.01); *D06F 33/00* (2013.01); *D06F 34/18* (2020.02); *D06F 35/008* (2013.01); *D06F 37/04* (2013.01); *D06F 37/304* (2013.01); *D06F 39/085* (2013.01); *D06F 37/266* (2013.01); *D06F 39/083* (2013.01); *D06F 39/14* (2013.01); *D06F 2204/086* (2013.01)

(58) Field of Classification Search

CPC ..... D06F 39/06

See application file for complete search history.

(56) References Cited

U.S. PATENT DOCUMENTS

2009/0272003 A1* 11/2009 Dalton ..... D06F 34/22 34/329

FOREIGN PATENT DOCUMENTS

| | | |
|---|---|---|
| DE | 102012100895 | 10/2012 |
| EP | 2112262 | 10/2009 |
| EP | 2348152 | 7/2011 |

(Continued)

OTHER PUBLICATIONS

PCT International Search Report in International Application No. PCT/KR2019/003356, dated Jul. 22, 2019, 4 pages.

(Continued)

*Primary Examiner* — Jason Y Ko

(74) *Attorney, Agent, or Firm* — Fish & Richardson P.C.

(57) ABSTRACT

A method of controlling a washing machine includes: rotating, by controlling a washing motor, a drum in a state in which a tub accommodates water; during the rotation of the drum, rotating a pump motor at a first pump rotation speed to spray water through at least one nozzle into the drum without interfering with a window of a door; and during the rotation of the drum, decelerating the pump motor from the first pump rotation speed to a second pump rotation speed to allow water sprayed from the at least one nozzle to be dropped to a portion of the window protruding into the tub.

20 Claims, 19 Drawing Sheets

(56) References Cited

FOREIGN PATENT DOCUMENTS

| | | |
|---|---|---|
| EP | 3192914 | 7/2017 |
| JP | 2009297139 | 12/2009 |
| KR | 1020070026923 | 3/2007 |
| KR | 1020090111603 | 10/2009 |
| KR | 1020170039995 | 4/2017 |
| WO | WO2014131452 | 9/2014 |

OTHER PUBLICATIONS

Extended European Search Report in European Application No. 19164596.9, dated Sep. 5, 2019, 10 pages.

* cited by examiner (a)

(b)

WASHING MACHINE AND METHOD FOR CONTROLLING THE SAME

CROSS-REFERENCE TO RELATED APPLICATION

This application claims the priority benefit of Korean Patent Application No. 10-2018-0034033, filed on Mar. 23, 2018, in the Korean Intellectual Property Office, the disclosure of which is incorporated herein by reference.

TECHNICAL FIELD

The present disclosure relates to a washing machine and a method for controlling the same, and more particularly, to a washing machine for washing a door by using a circulation nozzle, and a method for controlling the same.

BACKGROUND

Generally, a washing machine is provided with an input port, which is provided in a front surface of a casing, for loading laundry into a drum rotatably installed in the casing, and a door for opening and closing the input port.

A part of a rear surface of the door is in close contact with the front surface of the casing and the other part of the rear surface protrudes rearward and is inserted into the input port so that laundry or water contained in the drum is prevented from leaking out through the input port.

In such a washing machine, a detergent or a foreign matter may remain on the rear surface of the door during the operation of the washing machine, thereby deteriorating the washing effect.

Korean Patent Publication No. 10-2017-0099150 discloses a washing machine having a door cleaning nozzle for spraying washing water into a door and a washing reinforcing nozzle for spraying washing water into the drum.

This washing machine is capable of washing the door by using the door cleaning nozzle.

However, the door cleaning nozzle is provided separately from the cleaning reinforcing nozzle, and two flow paths branched from a single water supply pipe are configured to supply washing water to the two nozzles so that washing water is simultaneously sprayed through the two nozzles.

Since such a configuration has the door cleaning nozzle separately from the cleaning reinforcing nozzle, the structure becomes complicated, and the spraying pressure of the cleaning reinforcing nozzle is lowered due to the flow rate supplied to the door cleaning nozzle.

SUMMARY

A door of a washing machine may be contaminated by foreign matter separated from a laundry or residual water. If the door is left in a contaminated state, the laundry may be contaminated during washing, and the user may feel uncomfortable visually. The present disclosure has been made in view of the above problems, and provides a method for controlling a washing machine which washes a door by using a nozzle for spraying circulating water into a drum so as to wash laundry.

The present disclosure further provides a method for controlling a washing machine which washes a door by using a mechanism for washing, without providing a separate apparatus for washing the door.

The present disclosure further provides a method for controlling a washing machine which is set so as to most effectively wash a door in an entire washing process.

In accordance with an aspect of the present disclosure, a method of controlling a washing machine comprising a casing having an input port through which laundry is loaded; a tub provided in the casing; a drum rotatably installed in the tub; a door which is installed in the casing to open and close the input port, and includes a window at least a part of which reaches into the tub through the input port in a closed state of the input port; a washing motor for driving the drum; at least one nozzle which is disposed above the window and sprays water downward into the drum; and a pump for circulating water discharged from the tub to the at least one nozzle, wherein the pump includes a pump motor capable of varying a speed for controlling a flow rate circulated to the at least one nozzle, includes the steps of: (a) controlling the washing motor so that the drum rotates in a state where water filled in the tub; (b) controlling the pump motor at a first pump rotation speed such that water sprayed from the at least one nozzle is sprayed into the drum without interfering with the window during the rotation of the drum; and (c) during the rotation of the drum, decelerating the pump motor from the first pump rotation speed to a second pump rotation speed so that the water sprayed from the at least one nozzle is dropped into a portion of the window positioned in the tub.

The step (a) includes the steps of: (a-1) rotating the washing motor while maintaining a first drum rotation speed; (a-2) accelerating the washing motor from the first drum rotation speed to a second drum rotation speed; (a-3) decelerating the washing motor from the second drum rotation speed to the first drum rotation speed; and (a-4) rotating the washing motor while maintaining the first drum rotation speed, wherein the deceleration of the pump motor in the step (c) is performed in correspondence with the acceleration from the first drum rotation speed of the washing motor to the second drum rotation speed.

The method further includes a step of accelerating the pump motor from the second pump rotation speed to the first pump rotation speed in response to the deceleration from the second drum rotation speed of the washing motor to the first drum rotation speed.

The step (a) is repeated a plurality of times, and the deceleration from the first pump rotation speed of the pump motor to the second pump rotation speed and the acceleration from the second pump rotation speed to the first pump rotation speed are repeated a plurality of times, in response to a process in which the step (a) is repeated a plurality of times.

The step (a) includes the steps of: (a-1) rotating the washing motor while maintaining a first drum rotation speed; (a-2) accelerating the washing motor from the first drum rotation speed to a second drum rotation speed; (a-3) rotating the washing motor while maintaining the second drum rotation speed; (a-4) decelerating the washing motor from the second drum rotation speed to the first drum rotation speed; and (a-5) rotating the washing motor while maintaining the first drum rotation speed, wherein the deceleration and the acceleration of the pump motor in the step (c) are performed when the washing motor rotates while maintaining the second drum rotation speed.

The deceleration of the pump motor in the step (c) is performed in correspondence with a process in which the washing motor is accelerated from the first drum rotation speed and reaches the second drum rotation speed.

The deceleration of the washing motor in the step (a-4) is performed in correspondence with a process in which the pump motor is accelerated from the second pump rotation speed and reaches the first pump rotation speed.

The step (a) is repeated a plurality of times, and the deceleration from the first pump rotation speed of the pump motor to the second pump rotation speed and the acceleration from the second pump rotation speed to the first pump rotation speed are repeated a plurality of times, in response to a process in which the step (a) is repeated a plurality of times.

The at least one nozzle is disposed in front of the drum to spray water toward the drum.

In the step (a), the washing motor rotates the drum in one direction so that laundry is raised to a certain height while being attached to an inner circumferential surface of the drum and then dropped.

The first drum rotation speed is set in a range where the laundry in the drum is raised to a certain height while being attached to an inner circumferential surface of the drum and then dropped when the washing motor rotates while maintaining the first drum rotation speed, wherein the second drum rotation speed is equal to or higher than a speed at which the laundry in the drum is not separated from the drum even when the laundry reaches a highest point of the drum while being attached to the inner circumferential surface of the drum due to the rotation of the drum.

The step (a) is performed, after a step in which washing water in the tub is drained and washing water having no dissolved detergent is supplied into the tub.

The step in which washing water in the tub is drained and washing water having no dissolved detergent is supplied into the tub is performed a plurality of times, wherein the step (a) is performed after washing water having no dissolved detergent is supplied into the tub finally.

The method further includes a step (d) of accelerating the drum at a high speed so as to allow water soaked in the laundry to escape, draining the washing water in the tub, and supplying the washing water having no dissolved detergent into the tub, wherein the step (a) is performed after the step (d).

The step (d) includes a step (d-1) of controlling the washing motor so that the laundry is not detached from the drum even if the laundry in the drum reaches a highest point of the drum while being attached to the inner circumferential surface of the drum due to the rotation of the drum, and supplying the washing water having no dissolved detergent into the tub.

In the step (d-1), the water in the tub is discharged.

The step (d) includes a step (d-2) of controlling the washing motor above a speed at which the laundry in the drum is not separated from the drum even when the laundry reaches a highest point of the drum while being attached to the inner circumferential surface of the drum due to the rotation of the drum, and controlling the pump motor to spray water through the at least one nozzle.

The method further includes a step of detecting a laundry amount in the drum, wherein the first rotation speed is set based on the detected laundry amount.

In accordance with another aspect of the present disclosure, a washing machine includes: a casing having an input port through which laundry is loaded; a tub which is provided in the casing and accommodates water; a drum which is rotatably installed in the tub and accommodates laundry; a door which is installed in the casing to open and close the input port, and includes a window at least a part of which reaches into the tub through the input port in a closed state of the input port; a washing motor for driving the drum; at least one nozzle which is disposed above the window and sprays water downward into the drum; a pump which circulates water discharged from the tub to the at least one nozzle, and includes a pump motor capable of varying a speed for controlling a flow rate circulated to the at least one nozzle; and a controller which controls the washing motor to rotate the drum, controls the pump motor so that water is sprayed from the at least one nozzle during rotation of the drum, and controls the pump motor to rotate at a first rotation speed so that the water sprayed from the at least one nozzle does not interfere with the window and is sprayed into the drum, and then to decelerate from the first rotation speed to a second rotation speed so that the water sprayed from the at least one nozzle is dropped into a protruding portion of the window.

According to the control method of the washing machine of the present disclosure, one or more of the following effects can be obtained.

First, the door can be effectively cleaned by using a nozzle that sprays circulating water into the drum so as to wash the laundry without requiring a separate nozzle for washing the door.

Second, the door can be cleaned by controlling the rotation speed of the pump motor provided in the washing machine without a separate driving apparatus for cleaning the door.

As a result, by controlling the door to be cleaned in the middle of the washing process, the washing effect of the laundry is improved and the inconvenience of the user having to clean the door can be minimized.

BRIEF DESCRIPTION OF THE DRAWINGS

The above and other objects, features and other advantages of the present disclosure will be more clearly understood from the following detailed description taken in conjunction with the accompanying drawings, in which.

DETAILED DESCRIPTION

Figure 1:
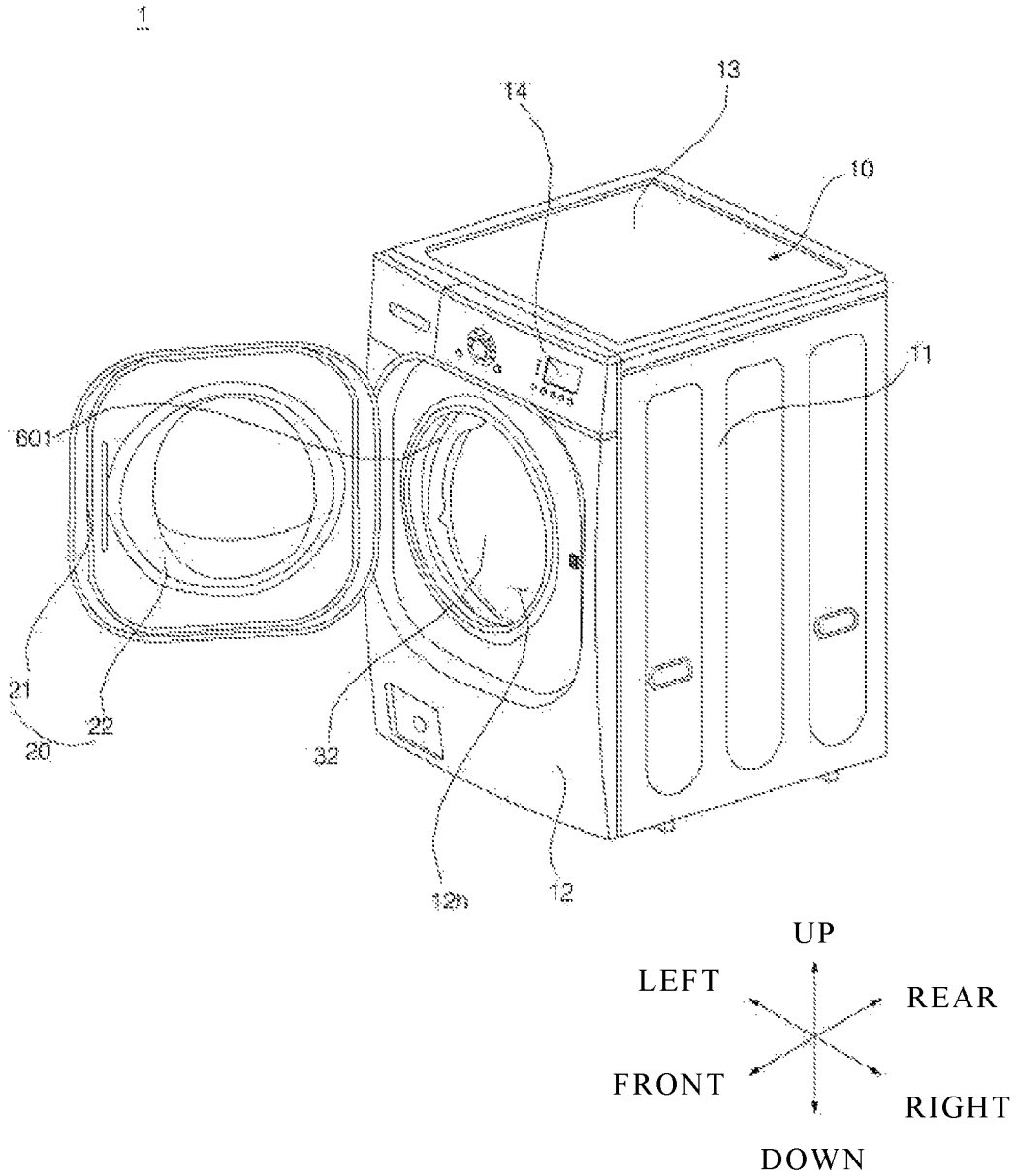
FIG. 1 is a perspective view showing a washing machine according to an embodiment of the present disclosure.

Advantages and features of the present disclosure and methods for achieving them will be made clear from the embodiments described below in detail with reference to the accompanying drawings. The present disclosure may, however, be embodied in many different forms and should not be construed as being limited to the embodiments set forth herein. Rather, these embodiments are provided so that this disclosure will be thorough and complete, and will fully convey the scope of the disclosure to those skilled in the art. The present disclosure is defined only by the scope of the claims. Like reference numerals refer to like elements throughout the specification.

Figure 2:
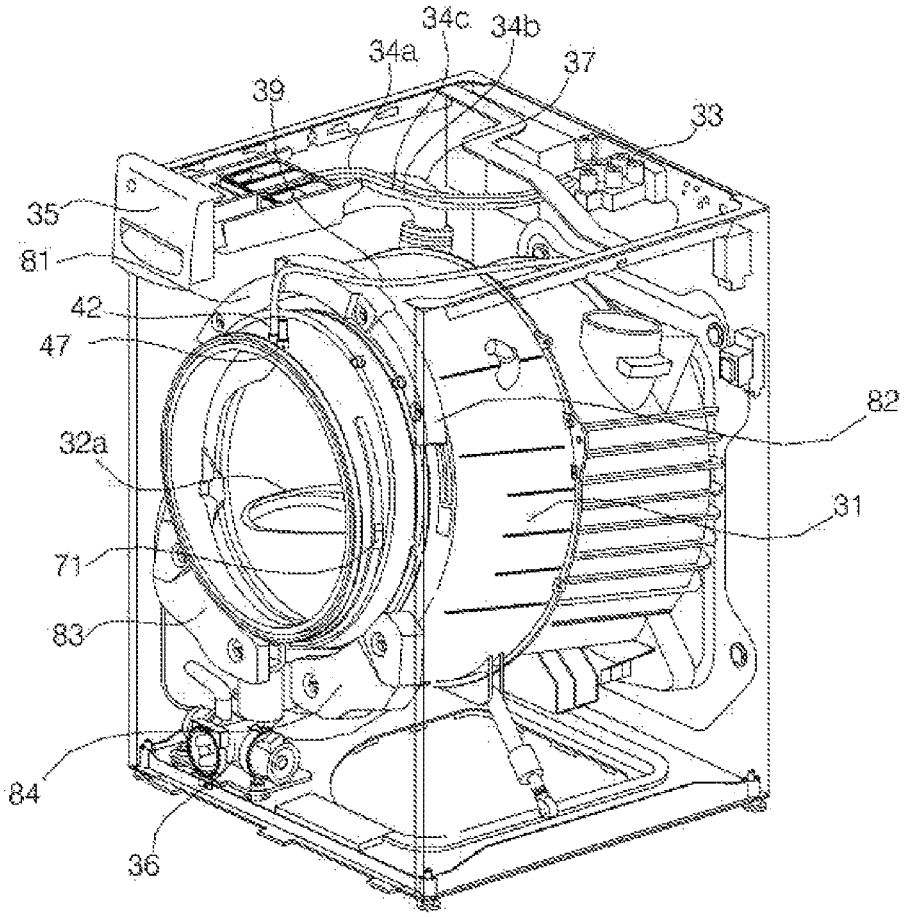
FIG. 2 shows a part of the washing machine shown in FIG. 1.
Figure 3:
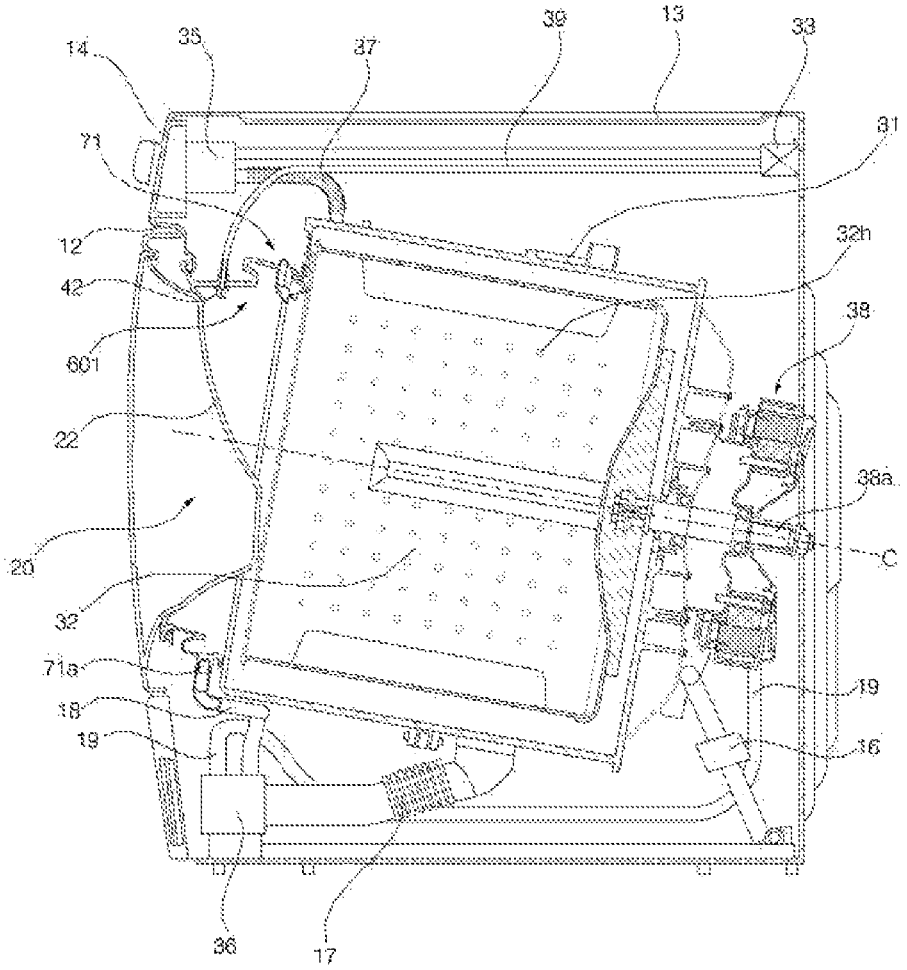
FIG. 3 is a side cross section view of the washing machine shown in FIG. 2.

FIG. 1 is a perspective view showing a washing machine according to an embodiment of the present disclosure. FIG. 2 shows a part of the washing machine shown in FIG. 1. FIG. 3 is a side cross section view of the washing machine shown in FIG. 2.

Referring to FIG. 1 to FIG. 3, a casing 10 defines an outer appearance of a washing machine, and an input port 12*h* through which laundry is loaded is formed in a front surface thereof. The casing 10 may include a cabinet 11 having a front surface that is opened, a left surface, a right surface, and a rear surface, and a front panel 12 coupled to the opened front surface of the cabinet 11 and having the input port 12*h* formed therein. A bottom surface and a top surface of the cabinet 11 are opened, and a horizontal base supporting the washing machine may be coupled to the bottom surface of the cabinet 11. In addition, the casing 10 may further include a top plate 13 covering the opened top surface of the cabinet 11 and a control panel 14 disposed above the front panel 12.

A tub 31 containing water may be disposed in the casing 10. An opening is formed in the front surface of the tub 31 so that laundry can be inputted. The cabinet 11 and the tub are connected to each other by an annular gasket 601 so that a path for inputting and outputting the laundry is formed in a section ranging from the opening of the tub 31 to the input port 12*h*.

A door 20 for opening and closing the input port 12*h* may be rotatably coupled to the casing 10. The door 20 may include a door frame 21 that is opened at a substantially central portion and is rotatably coupled to the front panel and a transparent window 22 that is installed at the opened central portion of the door frame 21. The window 22 may be convexly shaped rearward so that at least a portion thereof may be positioned in an area surrounded by an inner circumferential surface of the gasket 601.

The gasket 601 serves to prevent water contained in the tub 31 from leaking. The gasket 601 may have a tubular shape that has a front end portion and a rear end portion which are formed in an annular shape, and is extended from the front end portion to the rear end portion. The front end portion of the gasket 601 is fixed to the casing 10 and the rear end portion is fixed to the circumference of the opening of the tub 31. The gasket 601 may be made of a flexible or resilient material. The gasket 601 may be made of natural rubber or synthetic resin.

Hereinafter, the portion of the gasket 601 defining the inside of the tubular shape is referred to as an inner circumferential portion (or an inner circumferential surface) of the gasket 601, and the portion opposite thereto is referred to as an outer circumferential portion (or the outer side surface) of the gasket 601.

In the tub 31, a drum 32 in which laundry is accommodated may be rotatably provided. The drum 32 accommodates the laundry, and an opening for inputting the laundry is disposed in the front surface of the drum 32. The drum 32 is rotated around a substantially horizontal rotation center line C. However, the above mentioned "horizontal" is not a term used mathematically as a strict sense. That is, when the rotation center line C is inclined at a certain angle with respect to the horizontal as in the embodiment, it is also considered to be substantially horizontal because it is closer to horizontal than vertical. A plurality of through holes 32*h* may be formed in the drum so that water in the tub 31 can be introduced into the drum 32.

A plurality of lifters 32*a* may be provided on the inner surface of the drum 32. The plurality of lifters 32*a* may be disposed at a certain angle with respect to the center of the drum 32. When the drum 32 rotates, the laundry is lifted up by the lifter 32*a* and then dropped repeatedly.

A driving unit 38 for rotating the drum 32 may be further provided, and a driving shaft 38*a* rotated by the driving unit 38 may be coupled with the drum 32 through a rear surface portion of the tub 31.

Preferably, the driving unit 38 includes a direct-drive type washing motor 38*b*. The washing motor 38*b* may include a stator fixed to the rear of the tub 31, and a rotor rotated by magnetic force acting between the stator and the rotor. The driving shaft 38*a* may be rotated integrally with the rotor.

The tub 31 may be supported by a damper 16 installed in the base. The vibration of the tub 31 caused by the rotation of the drum 32 is attenuated by the damper 16. Although not shown, according to the embodiment, a hanger (e.g., a spring) for hanging the tub 31 in the casing 10 may be further provided.

At least one water supply hose (not shown) for guiding water supplied from an external water source such as a faucet to the tub 31, and a water supply unit 33 for controlling the water supplied through the at least one water supply hose to be supplied to at least one water supply pipe 34*a*, 34*b*, 34*c* described later may be provided.

A dispenser 35 for supplying an additive such as a detergent, a fabric softener into the tub 31 or the drum 32 may be provided. In the dispenser 35, the additives may be separately accommodated according to their types. The dispenser 35 may include a detergent accommodating portion (not shown) for accommodating the detergent and a softener accommodating portion (not shown) for accommodating the fabric softener.

At least one water supply pipe 34*a*, 34*b*, 34*c* for selectively guiding the water supplied through the water supply unit 33 to each accommodating portion of the dispenser 35 may be provided. The water supply unit 33 may include at least one water supply valve 94 (see FIG. 13) for interrupting the at least one water supply pipe 34*a*, 34*b*, 34*c*, respectively.

The at least one water supply pipe 34*a*, 34*b*, 34*c* may include a first water supply pipe 34*a* for supplying cold water supplied through a cold water supply hose to the detergent accommodating portion, a second water supply pipe 34*b* for supplying the cold water supplied through the cold water supply hose to the softener accommodating portion, and a third water supply pipe 34*c* for supplying hot water supplied through a hot water supply hose to the detergent accommodating portion.

The gasket 601 may be provided with a direct water nozzle 42 for spraying water into the drum 32, and a direct water supply pipe 39 for guiding the water supplied through the water supply unit 33 to the direct water nozzle 42. The direct water nozzle 42 may be a vortex nozzle or a spray nozzle, but is not necessarily limited thereto. The direct water nozzle 42 may be disposed in a vertical line V when viewed from the front.

The water discharged from the dispenser 35 is supplied to the tub 31 through a water supply bellows 37. A water supply port (not shown) connected to the water supply bellows 37 may be formed on a side surface of the tub 31.

The tub 31 is formed with a drainage port for discharging water, and a drainage bellows 17 may be connected to the drainage port. A pump 36 for pumping water discharged from the tub 31 through the drainage bellows 17 may be provided. A drainage valve 96 for interrupting the drainage bellows 17 may be further provided.

The pump 36 may selectively perform the function of pumping the water discharged through the drainage bellows 17 to the drainage pipe 19 and the function of pumping the water discharged through the drainage bellows 17 to a circulation pipe 18. Hereinafter, the water which is pumped by the pump 36 and guided along the circulation pipe 18 is referred to as circulating water.

The pump 36 may include a first pump motor 92 and a second pump motor 93. The first pump motor 92 may be a circulation pump motor that pumps the circulating water discharged from the tub 32 to a plurality of nozzles 610*b*, 610*c*, 610*d*, and 610*e*. The second pump motor 93 may be a drainage pump motor for draining water from the tub 32.

The flow rate (or discharge water pressure) of the pump 36 is variable. To this end, the pump motors 92 and 93 may be variable speed motors capable of controlling the rotation speed. Each of the pump motors 92 and 93 may be a brushless direct current (BLDC) motor, but is not necessarily limited thereto. A driver for controlling the speed of the pump motor 92, 93 may be further provided, and the driver may be an inverter driver. The inverter driver converts AC power to DC power, and inputs to the motor at a desired frequency.

A controller 91 (see FIG. 13) for controlling the pump motors 92 and 93 may be further provided. The controller may include a proportional-integral controller (PI controller), a proportional-integral-derivative controller (PID controller), and the like. The controller may receive the output value of the pump motor (e.g., the output current) as an input, and control the output value of the driver so that the number of revolutions of the pump motor follows a preset target number of revolutions.

The controller 91 (see FIG. 13) may control not only the rotation speed of the pump motor 92, 93, but also the rotation direction. Particularly, since an induction motor used in a conventional pump may not control the rotation direction in starting, it is difficult to control the rotation of each impeller in a set direction, and the flow rate discharged from a discharge port varies depending on the rotation direction of the impeller. However, since the present disclosure can control the rotation direction of the pump motor 92, 93 in starting, the conventional problem does not occur, and the flow rate discharged through the discharge port can be constantly controlled.

Meanwhile, the controller 91 (see FIG. 13) may control not only the pump motor 92, 93 but also the overall operation of the washing machine, and it will be understood that the control of each unit mentioned below is performed by the control of the controller.

Referring to FIG. 2, at least one balancer 81, 82, 83, 84 may be provided on the front surface of the tub 31 along the opening of the tub 31. The balancer 81, 82, 83, 84 is implemented to reduce the vibration of the tub 31, and is a weight body having a certain weight. A plurality of balancers 81, 82, 83, 84 may be provided. A first upper balancer 81 and a second upper balancer 82 may be provided in the left and right sides of the front upper portion of the tub 31, and a first lower balancer 83 and a second lower balancer 84 may be provided in the left and right sides of the front lower portion of the tub 31, respectively.

Figure 4:
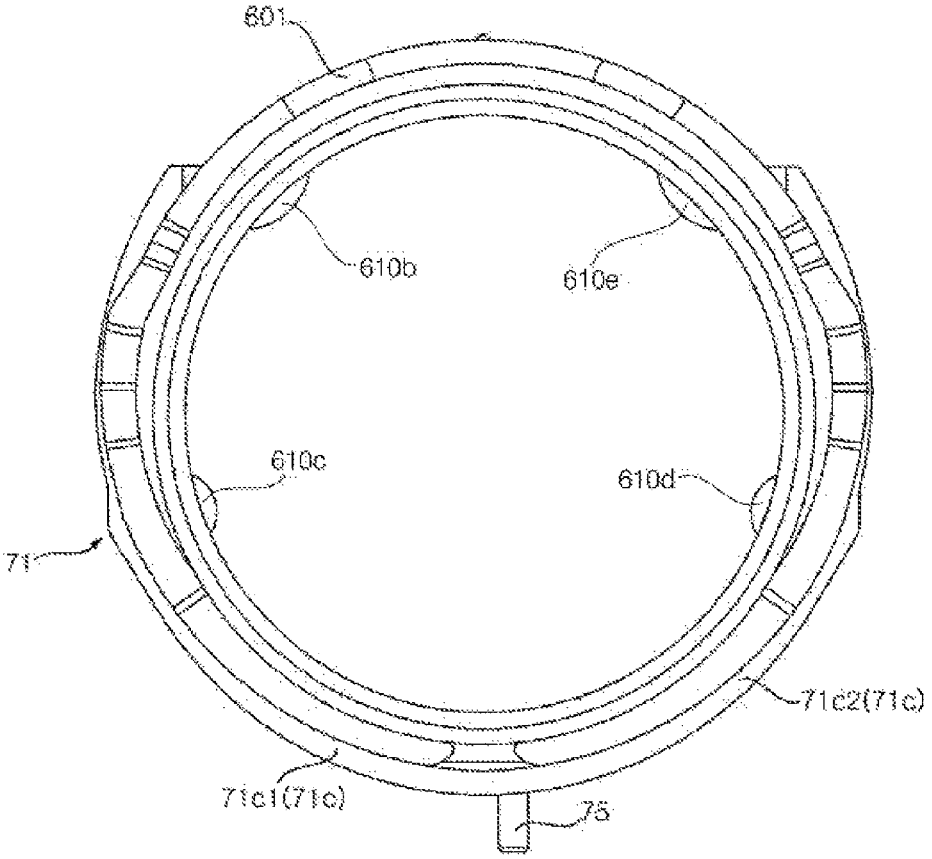
FIG. 4 shows an assembly of a gasket and a nozzle water pipe.
Figure 5:
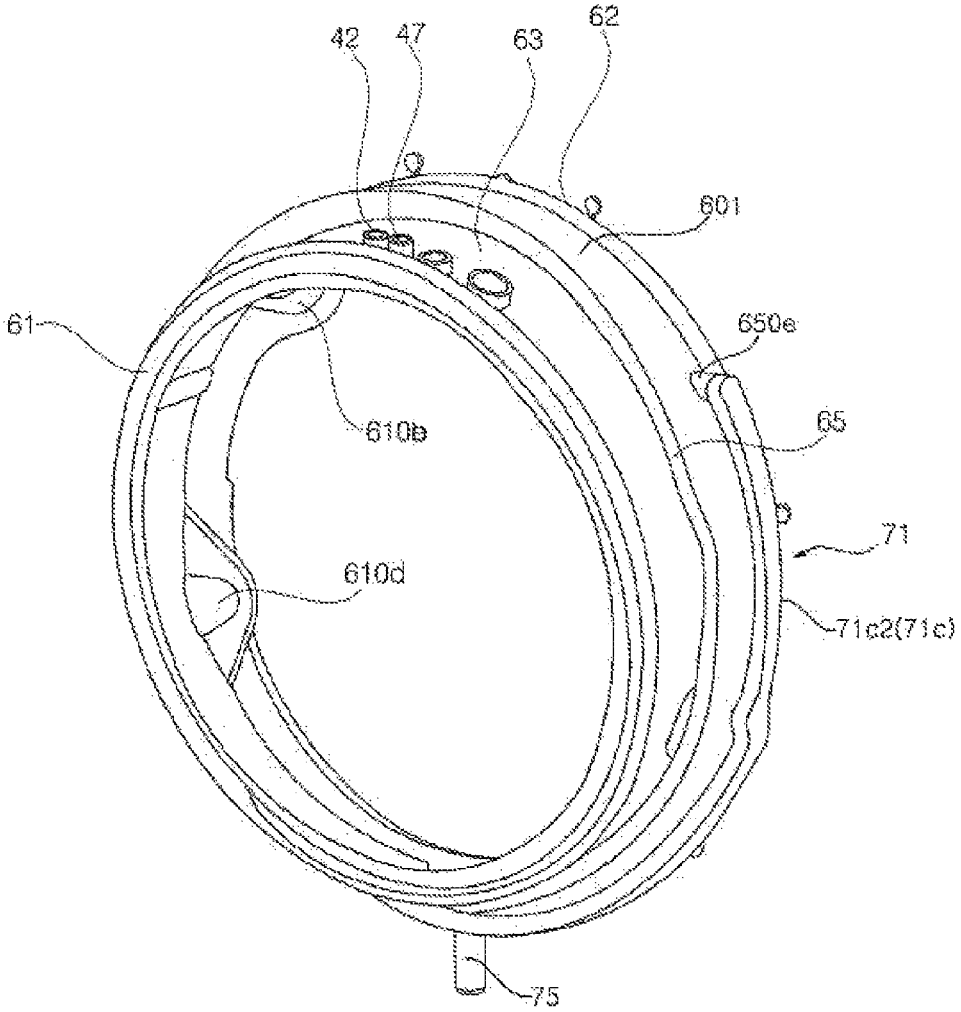
FIG. 5 is a view of the assembly shown in FIG. 4 from a different angle.

FIG. 4 shows an assembly of a gasket and a nozzle water pipe. FIG. 5 is a view of the assembly shown in FIG. 4 from a different angle.

Referring to FIG. 5, the gasket 601 may include a casing coupling portion 61 coupled to the circumference of the input port 12*h* of the casing 10, a tub coupling portion 62 coupled to the circumference of the opening of the tub 31, and an extension portion 63 extended between the casing coupling portion 61 and the tub coupling portion 62.

The casing coupling portion 61 and the tub coupling portion 62 are formed in an annular shape respectively. The extension portion 63 may be formed in an annular shape that has an annular front end portion connected to the casing coupling portion 61 and an annular rear end portion connected to the tub coupling portion 62 and extended from the front end portion to the rear end portion.

Referring to FIG. 2, in the front panel 12, the circumference of the input port 12*h* is curled outward, and the casing coupling portion 61 may be fitted into the concave portion formed by the curled portion.

The casing coupling portion 61 may be formed with an annular groove onto which a wire is wound. After the wire is wound along the groove, both ends of the wire are engaged, so that the casing coupling portion 61 is firmly fixed to the circumference of the input port 12*h*.

Referring to FIG. 2, in the tub 31, the circumference of the opening is curled outward, and the tub coupling portion 62 is fitted into the concave portion formed by the curled portion. The tub coupling portion 62 may be formed with an annular groove onto which a wire is wound. After the wire is wound along the groove, the both ends of the wire are engaged, so that the tub coupling portion 62 is firmly fixed to the circumference of the opening of the tub 31.

Meanwhile, the casing coupling portion 61 is fixed to the front panel 12, but the tub coupling portion 62 is displaced depending on the movement of the tub 31. Therefore, the extension portion 63 should be able to deform in response to the displacement of the tub coupling portion 62. In order to easily achieve such deformation, the gasket 601 may be provided with a hinge portion 65, which is formed in a section (or the extension portion 63) between the casing coupling portion 61 and the tub coupling portion 62, that is folded as it is moved in the direction (or radial direction) in which the tub 31 is moved by the eccentricity, The drum 32 is vibrated (i.e., the rotation center line C of the drum 32 is moved) during the rotation process. Accordingly, the center line of the tub 31 (approximately the same as the rotation center line C of the drum 32) is also moved, and the moving direction at this time (hereinafter referred to as "eccentric direction") has a radial direction component.

The hinge portion 65 is formed in a substantially Z shape so that it is folded or unfolded when the tub 31 moves in the eccentric direction.

Referring to FIGS. 4 and 5, the gasket 601 includes a plurality of nozzles 610*b*, 610*c*, 610*d*, and 610*e* for spraying the circulating water into the drum 32. A plurality of nozzles 610*b*, 610*c*, 610*d*, and 610*e* may be formed in the inner circumferential portion of the gasket 601.

The nozzle water pipe 71 guides the circulating water pumped by the pump 36 to the plurality of nozzles 610*b*, 610*c*, 610*d* and 610*e*, and is fixed to the gasket 601.

The nozzle water pipe 71 includes a circulation pipe connection port 75 connected to a circulation pipe 18*a* and a transfer conduit 71*c* for guiding the water introduced through the circulation pipe connection port 75.

The transfer conduit 71*c* includes a first conduit portion 71*c*1 forming a first flow path and a second conduit portion 71*c*2 forming a second flow path. One end of the first conduit portion 71*c*1 and one end of the second conduit portion 71*c*2 are connected to each other, and the circulation pipe connection port 75 protrudes from the connected portion. However, the other end of the first conduit portion 71*c*1 and the other end of the second conduit portion 71*c*2 are separated from each other, unlike the above-described examples. That is, the transfer conduit 71*c* is formed in a Y-shape as a whole and branches and guides the circulating water introduced through a single inlet (i.e., the circulation pipe connection port 75) into two flow paths. At this time, the two flow paths are separated from each other.

The transfer path 71*c* is formed in an annular shape as a whole, but a part of the circumference is cut. That is, the cut portion in the circumference corresponds to between the first conduit portion 71*c*1 and the second conduit portion 71*c*2.

The nozzle water pipe 71 may include a circulation pipe connection port 75 protruding from the transfer conduit 71*c* and connected to the circulation pipe 18. The circulation pipe connection port 75 may protrude outward along the radial direction from the transfer conduit 71*c*.

The plurality of nozzles 610*b*, 610*c*, 610*d* and 610*e* may include a pair of middle nozzles 610*b* and 610*e* which is disposed closer to an upper end of the gasket 601 than the lower end and sprays the circulating water downward, and a pair of lower nozzles 610*c* and 610*d* which is disposed below the pair of middle nozzles 610*b* and 610*e* and sprays the circulating water upward.

Meanwhile, the plurality of nozzles 610*b*, 610*c*, 610*d*, and 610*e* may include an upper nozzle disposed above the pair of middle nozzles 610*b* and 610*e*. The upper nozzle may spray water into the drum 32 and spray water closer to the front surface of the drum 32 than the pair of middle nozzles 610*b* and 610*e*.

According to the embodiment, the upper nozzle is constituted by the direct water nozzle 42, and may spray the washing water, which is supplied from an external water source and has no dissolved detergent, into the drum 32.

Alternatively, the upper nozzle may be connected to the nozzle water pipe 71 so that the circulating water pumped by the pump 36 may be sprayed.

Hereinafter, the case where an upper nozzle 610*a* (see FIG. 7) is the direct water nozzle 42 will be described as an example.

The pair of lower nozzles 610*c* and 610*d* may include a first lower nozzle 610*c* and a second lower nozzle 610*d* which are symmetrically disposed.

The pair of middle nozzles 610*b* and 610*e* may include a first middle nozzle 610*b* and a second middle nozzle 610*e* which are symmetrically disposed.

The circulation pipe connection port 75 is connected to the transfer conduit 71*c* from the lowermost side of the plurality of nozzles 610*b*, 610*c*, 610*d*, and 610*e*. Preferably, the circulation pipe connection port 75 is connected to the lowest point of the transfer conduit 71*c*.

That is, an inlet port through which the water introduced from the circulation pipe connection port 75 may be positioned in the lowest point of the transfer conduit 71*c*. The pair of middle nozzles 610*b* and 610*e* may be formed on the upper side of the inlet port, and disposed in the left and right sides, respectively, based on the inlet port. The pair of middle nozzles 610*b* and 610*e* are disposed symmetrically with respect to a vertical line passing through the center of the transfer conduit 71*c*. Accordingly, the spray direction of each middle nozzle 610*b*, 610*e* is also symmetrical with respect to the vertical line.

The pair of middle nozzles 610*b* and 610*e* may be positioned above the center of the nozzle water pipe 71 or the center C of the drum 32. Since each middle nozzle 610*b*, 610*e* sprays the circulating water downward, when the drum 32 is viewed from the front, the circulating water passes through an area above the center C of the drum 32 at the opening side of the drum 32, and is sprayed in a downwardly inclined manner as it progresses deeply into the drum 32.

The pair of lower nozzles 610*c* and 610*d* are disposed above the inlet port, but below the pair of middle nozzles 610*b* and 610*e*. The pair of lower nozzles 610*c* and 610*d* may be disposed in the left and right sides of the inlet, respectively, and preferably symmetrically with respect to the vertical line so that the spray direction of the lower nozzles 610*c* and 610*d* is symmetrical with respect to the vertical line.

The pair of lower nozzles 610*c* and 610*d* may be positioned below the center of the nozzle water pipe 71 or the center C of the drum 32. Since each lower nozzles 610*c*, 610*d* sprays the circulating water upward, when the drum 32 is viewed from the front, the circulating water passes through an area below the center C of the drum 32 at the opening side of the drum 32, and is sprayed in a upwardly inclined manner as it progresses deeply into the drum 32.

The upper nozzle 610*a* is preferably disposed in a vertical line, and the form of the circulating water sprayed through the upper nozzle 610*a* is symmetrical with respect to the vertical line.

The controller 91 may vary the spray pressure of the plurality of nozzles 610*b*, 610*c*, 610*d*, and 610*e* by controlling the speed of the first pump motor 92.

The gasket 601 may be formed symmetrically with respect to a certain straight line when viewed from the front, and the upper nozzle 610*a* may be positioned in the straight line. Since the first nozzles 610*b* and 610*c* are disposed symmetrically with respect to the second nozzles 610*d* and 610*e* based on the straight line, when spray is performed simultaneously through the plurality of nozzles 610*b*, 610*c*, 610*d* and 610*e* and the upper nozzle 610*a*, the overall form of the water flows sprayed through the nozzles 610*a*, 610*b*, 610*c*, 610*d*, and 610*e* is balanced with bilateral symmetry when viewed from the front.

In addition, when spray is performed simultaneously through the nozzles 610*a*, 610*b*, 610*c*, 610*d*, and 610*e*, a star-shaped spray may be implemented.

Meanwhile, when spray is performed simultaneously through the plurality of nozzles 610*b*, 610*c*, 610*d*, and 610*e* that spray the circulating water pumped by the pump 36 excluding the upper nozzle 610*a* constituted by the direct water nozzle, a butterfly-shaped spray may be implemented. In this case, the controller varies the rotation speed of the pump motor 92 to vary the spray pressure in the plurality of nozzles 610*b*, 610*c*, 610*d*, and 610*e*, so that a spray form in which the butterfly swings can be implemented and thus water can be uniformly sprayed into the drum 32.

The gasket 601 may be provided with a steam spray nozzle 47. The washing machine according to an embodiment of the present disclosure may include a steam generator (not shown) for generating steam. The steam spray nozzle 47 sprays steam generated by the steam generator into the drum 32.

Meanwhile, although not shown, the nozzle water pipe 71 may be formed in an annular shape other than the above-described "Y" shape. In this case, the upper nozzle 610*a* is configured to spray the circulating water pumped from the pump 36, so that the plurality of nozzles 610*a*, 610*b*, 610*c*, 610*d*, and 610*e* can simultaneously spray the circulating water.

Figure 6:
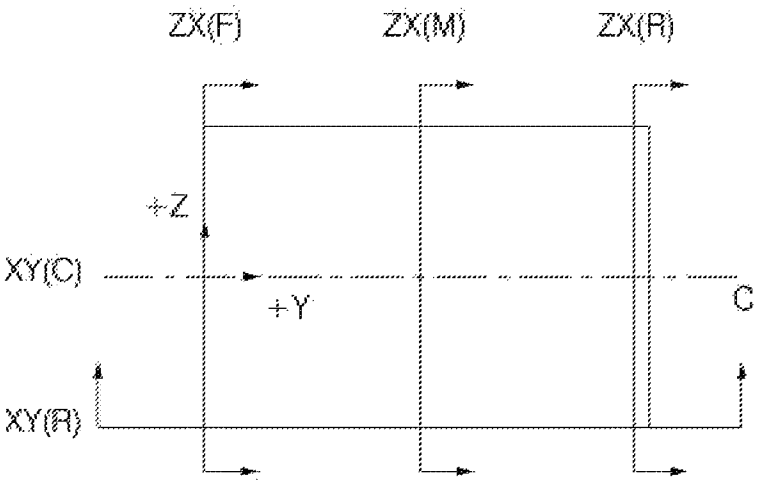
FIG. 6 schematically shows a drum (a) viewed from the top downward and a drum (b) viewed from the front.
Figure 6:
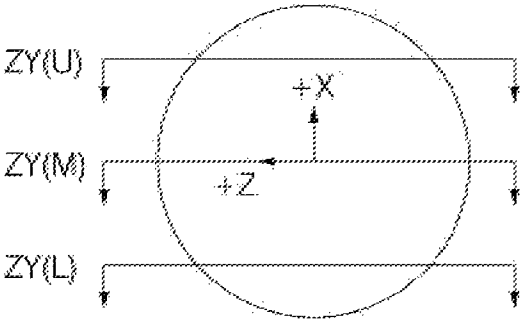

FIG. 6 schematically shows a drum (a) viewed from the top downward and a drum (b) viewed from the front. Referring to FIG. 6, the terms to be used below are defined.

In FIG. 6, based on the front of the drum 32, the rearward direction, the upward direction, and the leftward direction are indicated by +Y, +X, and +Z, respectively, ZX(F) indicates a ZX plane in approximately the front surface of the drum 32, ZX(M) indicates a ZX plane in approximately the middle depth of the drum 32, and ZX(R) indicates a ZX plane in the vicinity of a rear surface portion 322 of the drum 32.

In addition, XY(R) indicates the XY plane positioned in the right end of the drum 32, and XY(C) indicates the XY plane (or vertical plane) to which the center C of the drum 32 belongs.

In addition, YZ(M) indicates the YZ plane of approximately the middle height of the drum 32, YZ(U) indicates the YZ plane positioned above YZ(M), and YZ(L) indicates the YZ plane positioned below YZ(M).

Figure 7:
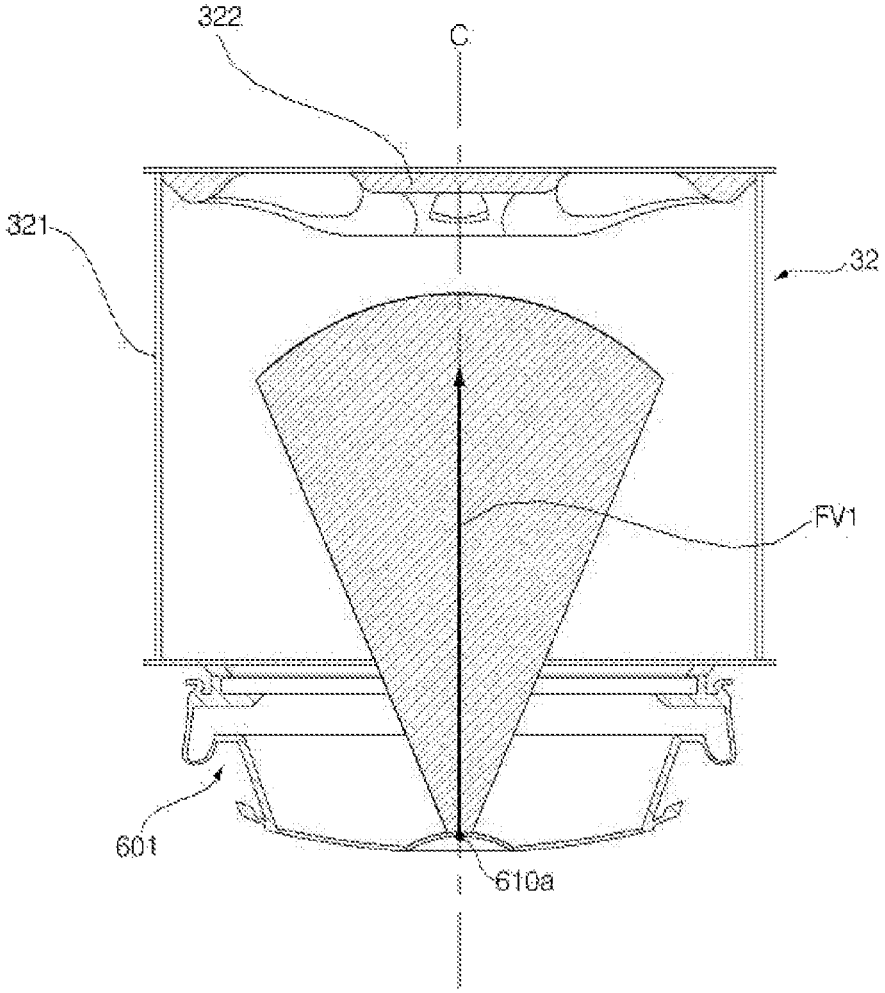
FIG. 7 is a view showing a spray pattern of an upper nozzle taken along YZ(U) shown in FIG. 6.
Figure 8A:
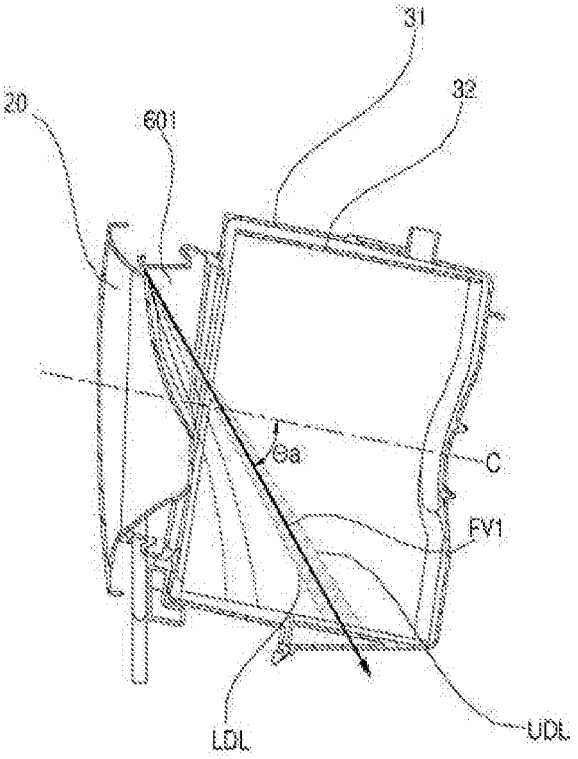
FIG. 8A is a view showing a spray pattern of an upper nozzle taken along XY(R) shown in FIG. 6.
Figure 8B:
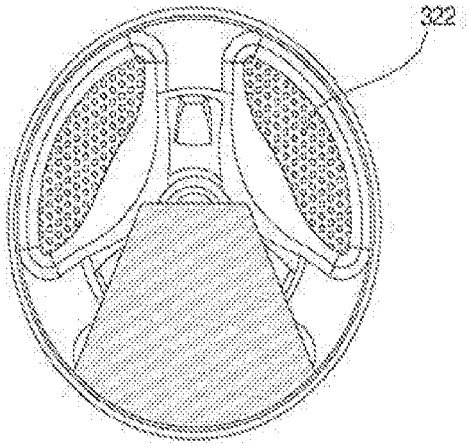
FIG. 8B is a view taken along ZX(M) shown in FIG. 6.

FIG. 7 is a view showing a spray pattern of an upper nozzle taken along YZ(U) shown in FIG. 6. FIG. 8A is a view showing a spray pattern of an upper nozzle taken along XY(R) shown in FIG. 6, and FIG. 8B is a view taken along ZX(M) shown in FIG. 6.

Referring to FIGS. 7 and 8, as shown in FIG. 8A, the water flow sprayed through the upper nozzle 610*a* is sprayed in the form of a water film having a certain thickness, and the thickness of the water film may be defined between an upper boundary UDL and a lower boundary LDL. Hereinafter, the water flow shown in the drawings indicates a surface constituting the upper boundary UDL, and a surface constituting the lower boundary LDL is omitted.

The water flow indicated by a dotted line in FIG. 8A indicates a case in which the water pressure is lowered than the case where it is indicated by a solid line (in the case of a maximum water pressure) (i.e., the case where the rotation speed of the pump motor is decreased). As the water pressure drops, the intensity of the water flow also weakens, so that the area that the water flow reaches is shifted to the opening side of the drum 32.

In particular, the window 22 is protruded toward the drum 32 more than the upper nozzle 610*a*. Accordingly, when the number of rotations of the pump motor is lowered than a certain level, the water flow sprayed through the upper nozzle 610*a* may reach the window 22, and in this case, the window 22 is cleaned.

The water flow sprayed through the upper nozzle 610*a* is symmetrical with respect to XY(C), and does not reach the rear surface portion 322 of the drum 32. As described above, since the spray direction of the upper nozzle 610*a* is determined according to the shape of the nozzle, even if the water pressure is continuously increased, the sprayed area cannot get out of a certain area. The water flows indicated by the solid line in FIGS. 7 to 12D show the state where the water flow is sprayed at the maximum intensity through respective nozzles.

Referring to FIGS. 7 and 8 again, the upper nozzle 610*a* may be configured to spray the circulating water toward a side surface portion 321 of the drum 32. Specifically, the upper nozzle 610*a* sprays the circulating water downward toward the inside of the drum 32. At this time, the sprayed circulating water arrives at the side portion 321 but does not reach a rear surface portion 322. Preferably, the water flow sprayed through the upper nozzle 610*a* reaches the side surface portion 321 of the drum 32 in an area exceeding half the depth of the drum 32 (see FIG. 8A).

Meanwhile, in FIGS. 7 to 8, the spray direction of the upper nozzle 610*a* is indicated by a vector FV1. Specifically, the vector FV1 is the flow direction of the center of the water flow sprayed in the form of a water film, and is indicated based on the exit of the upper nozzle 610*a*.

The vector FV1 has the same direction as the rotation center line C as shown in FIG. 7, when viewed from the top, and forms an angle θa with respect to the rotation center line C as shown in FIG. 8, when viewed from the side. θa is approximately 35 to 45 degrees, preferably, 40 degrees.

Figure 9:
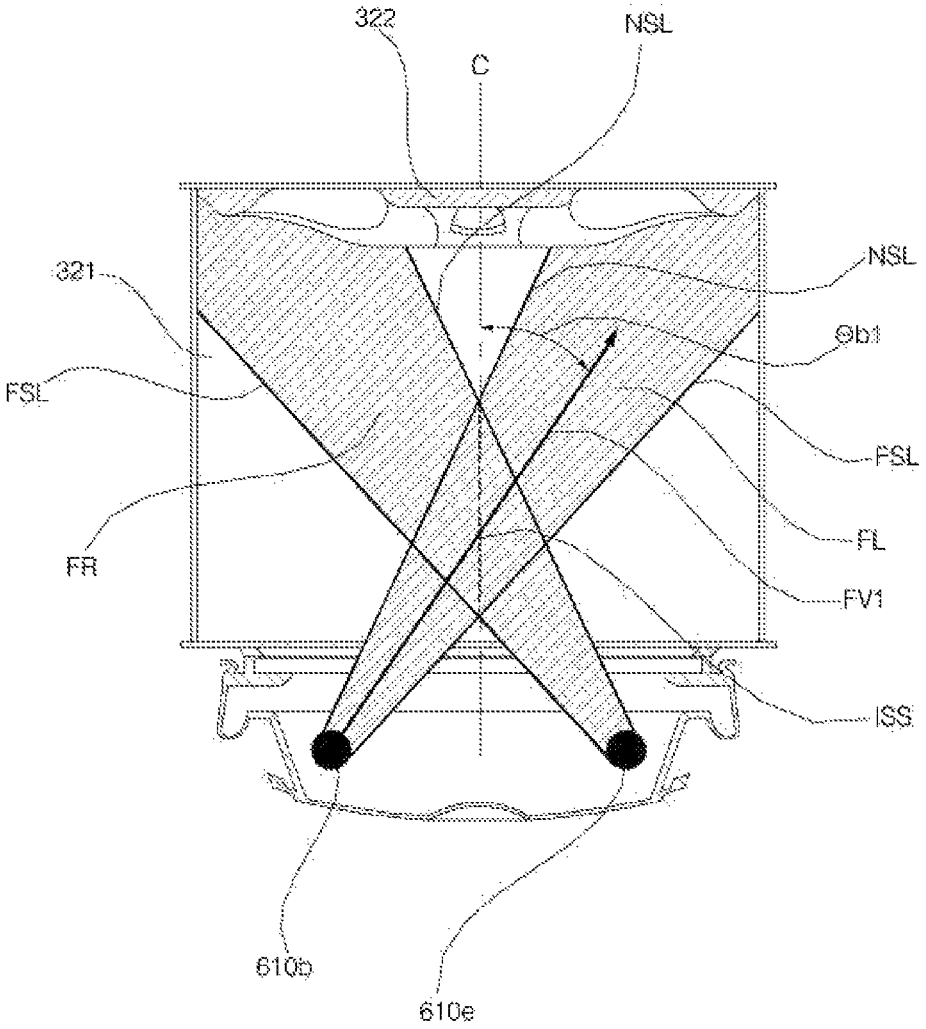
FIG. 9 is a view showing a spray pattern of middle nozzles taken along YZ(U) shown in FIG. 6.
Figure 10A:
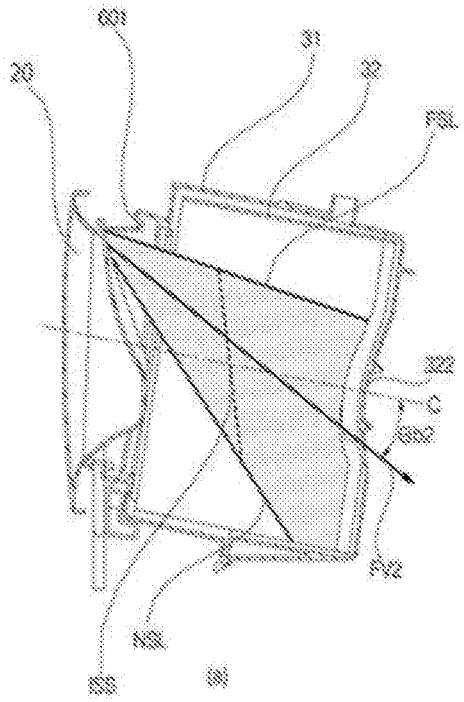
FIG. 10A is a view showing a spray pattern of a first middle nozzle taken along XY(R) shown in FIG. 6.
Figure 10B:
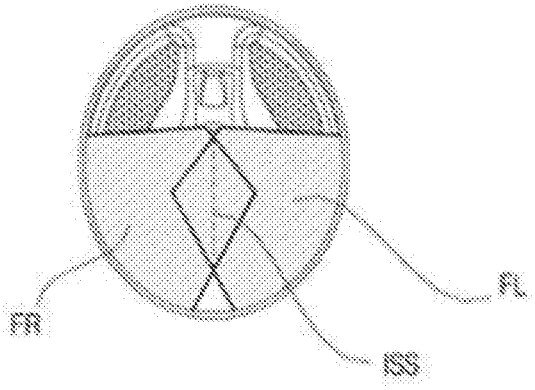
FIG. 10B is a view showing a spray pattern of middle nozzles 610*b* and 610*e* taken along ZX(F) shown in FIG. 6.
Figure 10C:
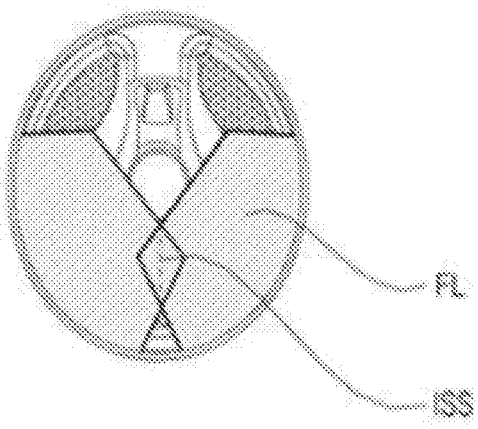
FIG. 10C is a view taken along ZX(M)
Figure 10D:
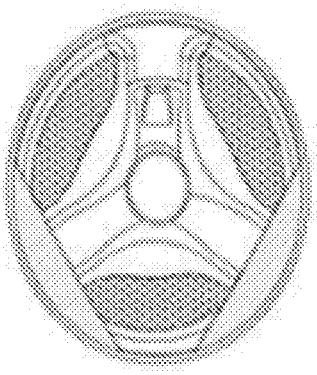
FIG. 10D is a view taken along ZX(R)

FIG. 9 is a view showing a spray pattern of middle nozzles taken along YZ(U) shown in FIG. 6. FIG. 10A is a view showing a spray pattern of a first middle nozzle taken along XY(R) shown in FIG. 6, FIG. 10B is a view showing a spray pattern of middle nozzles 610*b* and 610*e* taken along ZX(F) shown in FIG. 6, FIG. 10C is a view taken along ZX(M), and FIG. 10D is a view taken along ZX(R).

Referring to FIGS. 9 and 10A-10D, a pair of the middle nozzles 610*b* and 610*e* may include a first middle nozzle which is disposed in one side (or a first area) of the left and right sides based on the XY(C) plane and sprays the circulating water toward the other side (or a second area), and a second middle nozzle which is disposed in the other side based on the XY(C) plane and sprays the circulating water toward the one side.

The first middle nozzle 610*b* and the second middle nozzle 610*e* are disposed symmetrically with respect to the XY(C) plane, and the spray direction of each middle nozzle is also symmetrical. The water flow sprayed through each middle nozzle has a width defined between one side boundary NSL adjacent to the side where the nozzle is disposed and the other side boundary FSL opposite to the one side boundary NSL.

The one side boundary NSL may be positioned below the other side FSL, and preferably, one side boundary NSL meets the side surface portion 321 of the drum 32 while the other side boundary FSL meets the side surface portion 321 of the drum 32 at a position higher than the one side boundary NSL. That is, the water flows sprayed by the middle nozzle 610*b*, 610*e* constitute a tilted water film which is downward toward one side from the other side.

The water flow sprayed through each of the middle nozzles 610*b* and 610*e* reaches an area formed between a point where the one side boundary NSL meets the side surface portion 321 of the drum 32 and a point where the other side boundary FSL meets the side surface portion 321 of the drum, and the area includes an area that meets with the rear surface portion 322 of the drum 32. That is, a section where the water flow meets the drum 32 passes through the rear surface portion 322 of the drum 32 while progressing downward toward a point where the one side boundary NSL meets the side surface portion 321 of the drum 32 from a point where the other side boundary FSL meets the side surface portion 321 of the drum 32.

Hereinafter, it is illustrated that the first middle nozzle 610*b* is disposed in the left side (hereinafter, referred to as "left area") based on the XY(C) plane, and the second middle nozzle 610*e* is disposed in the right side (hereinafter, referred to as "right area") based on the XY(C) plane, and the spray form of the middle nozzles 610*b* and 610*e* will be described in more detail.

The first middle nozzle 610*b* sprays the circulating water toward the right area. That is, the water flow sprayed through the first middle nozzle 610*b* is not symmetrical with respect to the XY(C) plane but is deflected to the right.

The left boundary NSL (one side boundary NSL) of the water flow FL which is sprayed through the first middle nozzle 610*b* is positioned below the right boundary FSL (or the other side boundary FSL), and meets the side surface portion 321 of the drum 32. The right boundary FSL (or the other side boundary FSL) of the water flow FL sprayed through the first middle nozzle 610*b* also meets the side surface portion 321 of the drum 32.

The right boundary FSL of the water flow FL sprayed through the first middle nozzle 610*b*, preferably, meets the side surface portion 321 of the drum 32 at a position higher than the center C of the drum 32.

A section where the water flow FL sprayed through the first middle nozzle 610*b* meets the drum 32 meets the rear surface portion 322 of the drum 32 while progressing downwardly in the left direction from a point where the right boundary FSL meets the side surface portion 321 of the drum 32, and reaches a point where the left boundary NSL meets the side surface portion 321 of the drum 32 while meeting with the side surface portion 321 of the drum 32 again.

The second middle nozzle 610*e* sprays the circulating water toward the left area. That is, the water flow sprayed through the second middle nozzle 610*e* is not symmetrical with respect to the XY(C) plane but is deflected to the right.

The right boundary NSL (or one side boundary NSL) of the water flow FR sprayed through the second middle nozzle 610*e* is positioned below the left boundary FSL (or the other side boundary FSL), and meets the side surface portion 321 of the drum 32. The left boundary FSL (or the other side boundary FSL) of the water flow FR sprayed through the second middle nozzle 610*e* also meets the side surface portion 321 of the drum 32.

The left boundary FSL of the water flow FR sprayed through the second middle nozzle 610*e*, preferably, meets the side surface portion 321 of the drum 32 at a position higher than the center C of the drum 32.

A section where the water flow FR sprayed through the second middle nozzle 610*e* meets the drum 32 meets the rear surface portion 322 of the drum 32 while progressing downwardly in the right direction from a point where the left boundary FSL meets the side surface portion 321 of the drum 32, and reaches a point where the right boundary NSL meets the side surface portion 321 of the drum 32 while meeting with the side surface portion 321 of the drum 32 again.

In the drawing, a portion (hereinafter, referred to as "crossing section") where the water flow FL sprayed from the first middle nozzle 610*b* and the water flow FR sprayed from the second middle nozzle 610*e* intersect is indicated as ISS. The crossing section ISS starts from the front side of the middle depth of the drum 32, progresses rearward, and then ends before reaching the rear surface portion 322 of the drum 32. The crossing section ISS forms a downward line from the front end to the rear end when viewed from the side (See FIG. 10A). The crossing section ISS preferably ends in a place deeper than the middle depth of the drum 32 (See FIG. 10C).

Meanwhile, in FIG. 9 and FIGS. 10A-10D, the spray direction of the middle nozzle 610*b*, 610*e* is indicated as a vector FV2. Specifically, the vector FV2 is a flow direction at the center of the water flow sprayed in the form of a water film, and is indicated based on the exit of the middle nozzle 610*b*, 610*e*.

As shown in FIG. 9, the vector FV2 forms an angle θb1 with respect to the rotation center line C when viewed from the top, and forms an angle θb2 with respect to the rotation center line C when viewed from the side, as shown in FIG. 10A. θb1 is approximately 5 to 15 degrees, preferably, 10 degrees. θb2 is approximately 30 to 40 degrees, preferably, 34 to 35 degrees.

Meanwhile, when the water flow sprayed from the pair of middle nozzles 610*b* and 610*e* is sprayed below a certain pressure, it may reach the inner surface of the window 22. The controller (91 of FIG. 13) controls the pump motor (92 of FIG. 13) at a set speed so that the water flow sprayed from the pair of middle nozzles 610*b* and 610*e* reaches the inner surface of the window 22, 22, thereby cleaning the window 22. The control method of the washing machine for cleaning the door will be described later in detail with reference to FIGS. 16A and 16B and the following figures.

Figure 11:
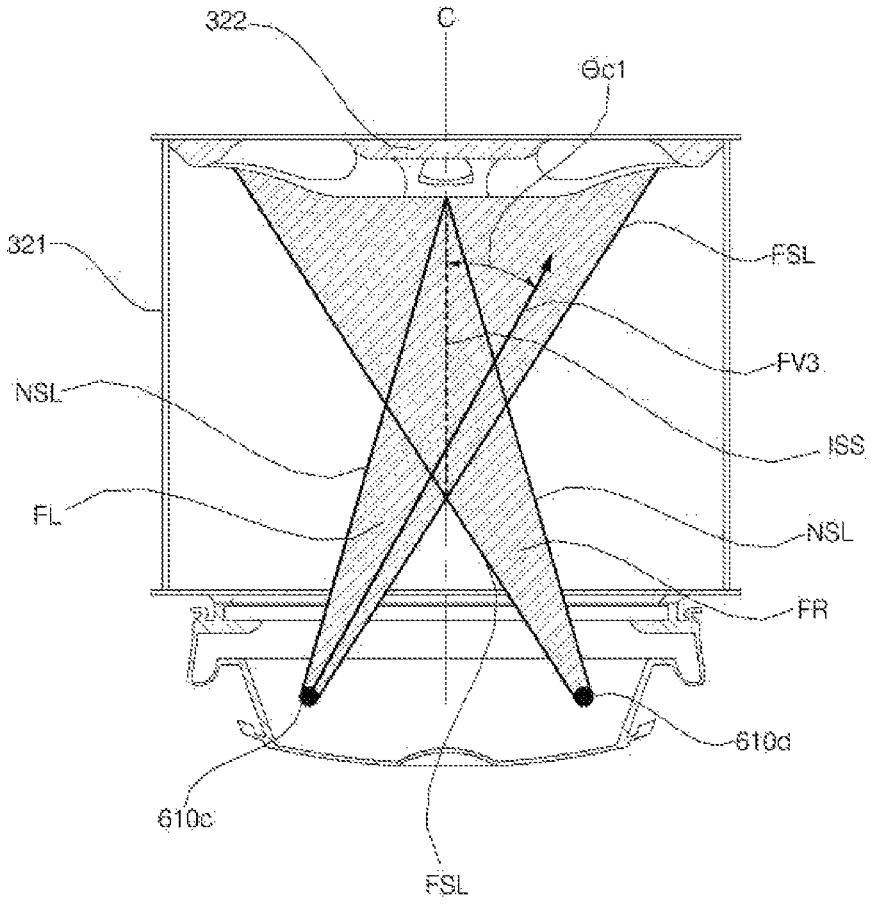
FIG. 11 is a view showing a spray pattern of lower nozzles taken along YZ(U) shown in FIG. 6.
Figure 12A:
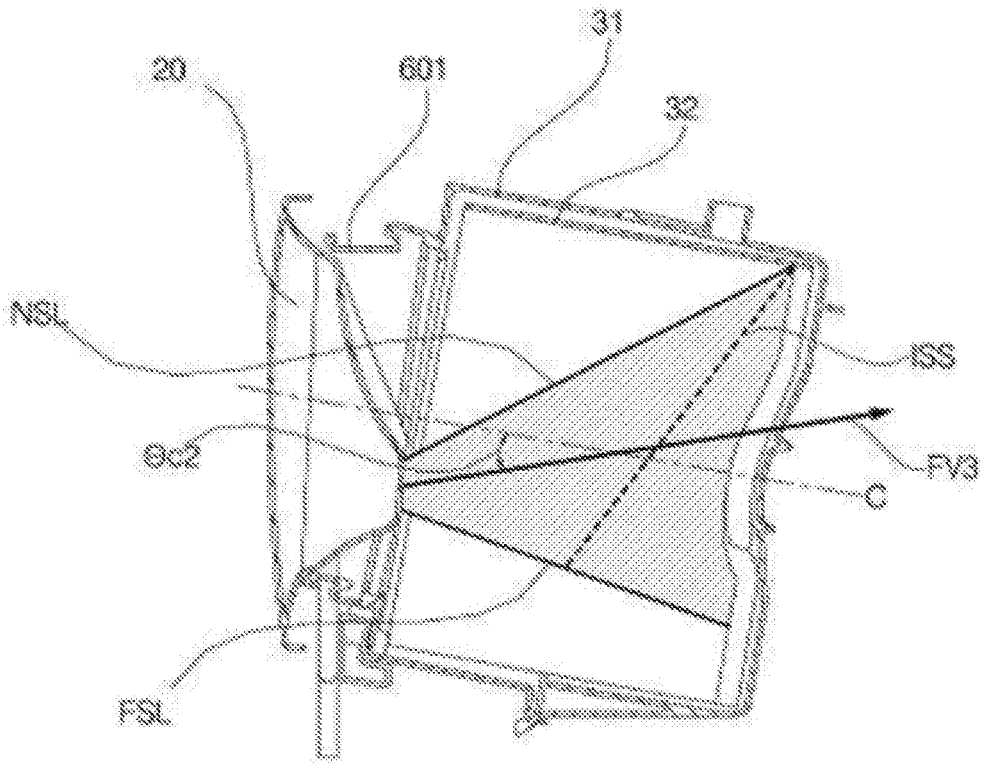
FIG. 12A is a view showing a spray pattern of a first lower nozzle taken along XY (R) shown in FIG. 6.
Figure 12B:
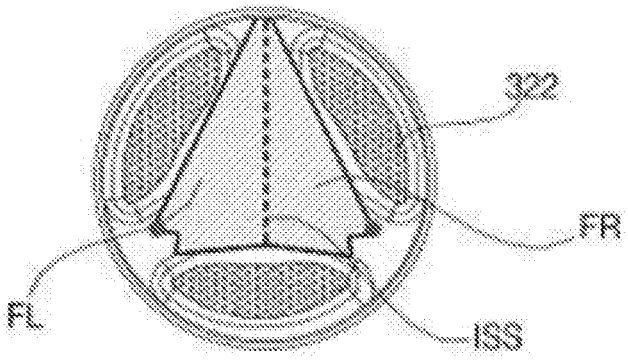
FIG. 12B is a view showing a spray patterns of lower nozzles taken along ZX(F) shown in FIG. 6.
Figure 12C:
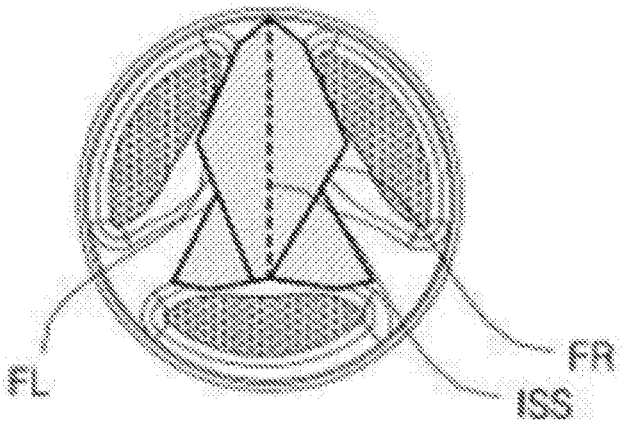
FIG. 12C is a view taken along ZX(M)
Figure 12D:
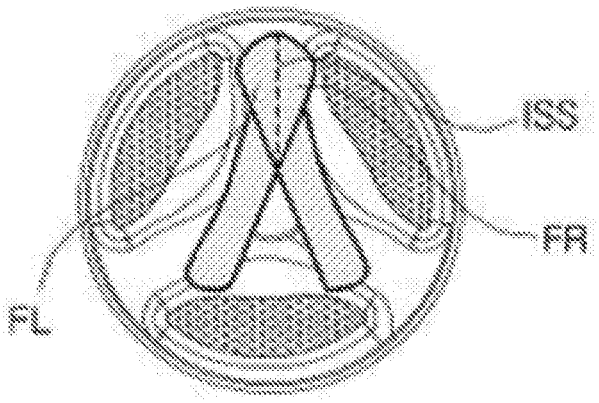
FIG. 12D is a view taken along ZX(R)

FIG. 11 is a view showing a spray pattern of lower nozzles taken along YZ(U) shown in FIG. 6. FIG. 12A is a view showing a spray pattern of a first lower nozzle taken along XY (R) shown in FIG. 6, FIG. 12B is a view showing a spray patterns of lower nozzles taken along ZX(F) shown in FIG. 6, FIG. 12C is a view taken along ZX(M), and FIG. 12D is a view taken along ZX(R).

Referring to FIGS. 11 and 12A-12D, a pair of the lower nozzles 610*c* and 610*d* may include a first lower nozzle 610*c* which is disposed in one side (or a first area) of the left and right sides based on the XY(C) plane and sprays the circulating water toward the other side (or a second area), and a second lower nozzle 610*d* which is disposed in the other side based on the XY(C) plane and sprays the circulating water toward the one side.

The first lower nozzle 610*c* and the second lower nozzle 610*d* are disposed symmetrically with respect to the XY(C) plane, and the spray direction of each lower nozzle is also symmetrical. The water flow sprayed through each lower nozzle has a width defined between one side boundary NSL adjacent to the side where the nozzle is disposed and the other side boundary FSL opposite to the one side boundary NSL.

The one side boundary NSL may be positioned above the other side FSL, and preferably, one side boundary NSL meets the rear surface portion 322 of the drum 32 while the other side boundary FSL meets the rear surface portion 322 of the drum 32 at a position lower than the one side boundary NSL. That is, the water flows sprayed by the lower nozzle 610*c*, 610*d* constitute a tilted water film which is downward toward the other side from one side.

The water flow sprayed through each of the lower nozzles 610*c* and 610*d* reaches an area formed between a point where the one side boundary NSL meets the rear surface portion 322 of the drum 32 and a point where the other side boundary FSL meets the rear surface portion 322 of the drum.

Hereinafter, it is illustrated that the first lower nozzle 610*c* is disposed in the left side (hereinafter, referred to as "left area") based on the XY(C) plane, and the second lower nozzle 610*d* is disposed in the right side (hereinafter, referred to as "right area") based on the XY(C) plane, and the spray form of the lower nozzles 610*c* and 610*d* will be described in more detail.

The first lower nozzle 610*c* sprays the circulating water toward the right area. That is, the water flow sprayed through the first lower nozzle 610*c* is not symmetrical with respect to the XY(C) plane but is deflected to the right.

The left boundary NSL (one side boundary NSL) of the water flow FL which is sprayed through the first lower nozzle 610*c* is positioned above the right boundary FSL (or the other side boundary FSL), and meets the rear surface portion 322 of the drum 32. The right boundary FSL (or the other side boundary FSL) of the water flow FL sprayed through the first lower nozzle 610*c* also meets the rear surface portion 322 of the drum 32.

The left boundary NSL of the water flow FL sprayed through the first lower nozzle 610*c*, preferably, meets the rear surface portion 322 of the drum 32 at a position higher than the center C of the drum 32. The right boundary FSL of the water flow FL sprayed through the first lower nozzle 610*c*, preferably, meets the rear surface portion 322 of the drum 32 at a position lower than the center C of the drum 32.

A section where the water flow FL sprayed through the first lower nozzle 610*c* meets the drum 32 reaches a point where the right boundary FSL meets the rear surface portion 322 of the drum 32 while progressing downwardly in the right direction from a point where the left boundary NSL meets the rear surface portion 322 of the drum 32.

The second lower nozzle 610*d* sprays the circulating water toward the left area. That is, the water flow sprayed through the second lower nozzle 610*d* is not symmetrical with respect to the XY(C) plane but is deflected to the right.

The right boundary NSL (or one side boundary NSL) of the water flow FR sprayed through the second lower nozzle 610*d* is positioned above the left boundary FSL (or the other side boundary FSL), and meets the rear surface portion 322 of the drum 32. The left boundary FSL (or the other side boundary FSL) of the water flow FR sprayed through the second lower nozzle 610*d* also meets the rear surface portion 322 of the drum 32.

The right boundary NSL of the water flow FR sprayed through the second lower nozzle 610*d*, preferably, meets the rear surface portion 322 of the drum 32 at a position higher than the center C of the drum 32. The left boundary NSL of the water flow FR sprayed through the first lower nozzle 610*c*, preferably, meets the rear surface portion 322 of the drum 32 at a position lower than the center C of the drum 32.

A section where the water flow FR sprayed through the second lower nozzle 610*d* meets the drum 32 reaches a point where the left boundary FSL meets the rear surface portion 322 of the drum 32 while progressing downwardly in the left direction from a point where the right boundary NSL meets the rear surface portion 322 of the drum 32.

In the drawing, a portion (hereinafter, referred to as "crossing section") where the water flow FL sprayed from the first lower nozzle 610*c* and the water flow FR sprayed from the second lower nozzle 610*d* intersect is indicated as ISS. The crossing section ISS forms an upward line from the front end to the rear end when viewed from the side (See FIG. 12A). The crossing section ISS preferably ends in a place (preferably, a place closer to the rear surface portion 322 than the middle depth of the drum 32) deeper than the middle depth of the drum 32 (See FIG. 12D).

Meanwhile, in FIG. 11 and FIGS. 12A-12D, the spray direction of the lower nozzle 610*c*, 610*d* is indicated as a vector FV3. Specifically, the vector FV3 is a flow direction at the center of the water flow sprayed in the form of a water film, and is indicated based on the exit of the middle nozzle 610*c*, 610*d*.

As shown in FIG. 11, the vector FV3 forms an angle θc1 with respect to the rotation center line C when viewed from the top, and forms an angle θc2 with respect to the rotation center line C when viewed from the side, as shown in FIG. 12A. θc1 is approximately 15 to 25 degrees, preferably, 20 degrees. θc2 is approximately 20 to 30 degrees, preferably, 25 to 26 degrees.

Figure 13:
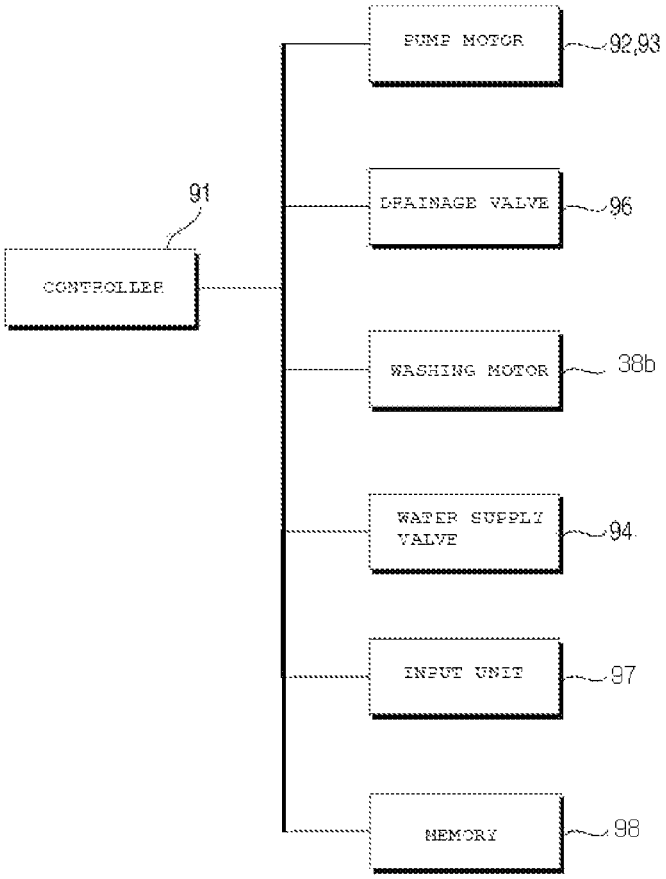
FIG. 13 is a block diagram illustrating a control relationship among configurations commonly applied to washing machines according to embodiments of the present disclosure.

FIG. 13 is a block diagram illustrating a control relationship among configurations commonly applied to washing machines according to embodiments of the present disclosure. Referring to FIG. 13, when a user inputs settings (e.g., washing course, washing, rinsing, spin-dry time, spin-dry speed, etc.) through an input unit 97 provided in the control panel 14, the controller 91 controls the washing machine to operate according to the input setting.

For example, control algorithm for the washing motor 38*b*, the pump motor 92, 93, the water supply valve 94, the drainage valve 96 and the like is stored in a memory 98 for each course that can be selected through the input unit 97. The controller 91 may control the washing machine to operate according to an algorithm corresponding to the setting inputted through the input unit 97.

Hereinafter, it is illustrated that the pump motor 92, 93 includes a circulation pump motor 92 for spraying water into the tub 31 through nozzles 610*c* and 610*d* and a drainage pump motor 93 for draining water contained the tub 31.

Under the control of the controller 91, the circulation pump may be operated (e.g., in washing), or the drain pump may be operated (e.g., in draining) according to a preset algorithm.

Meanwhile, the controller 91 may control not only the circulation pump motor 92 but also the drainage pump motor 93, and furthermore, may control the overall operation of the washing machine. It can be understood that the control of each unit described below is performed under the control of the controller 91, even if it is not mentioned.

Figure 14A:
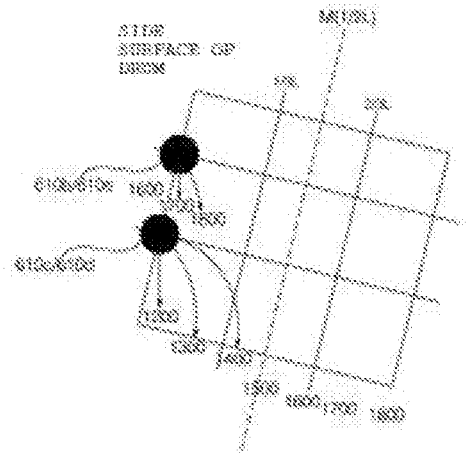
FIGS. 14A-14C are views showing example spray ranges of a nozzle according to the rotation speed of a pump motor according to an embodiment of the present disclosure.
Figure 14B:
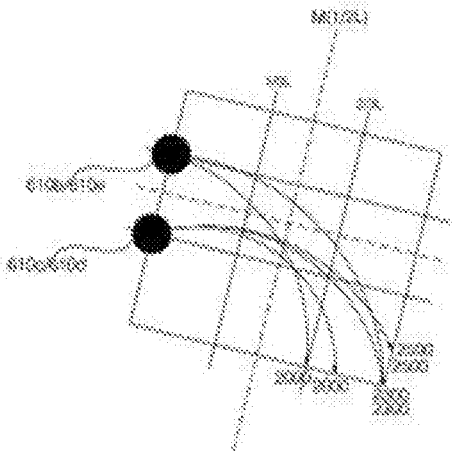
Figure 14C:
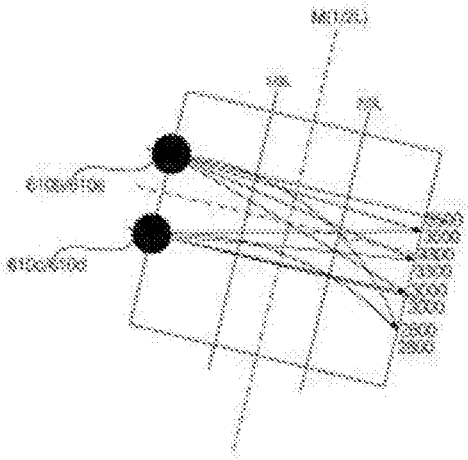

FIGS. 14A-14C are views for explaining examples of a spray range of a nozzle according to the rotation speed of a pump motor according to an embodiment of the present disclosure. Specifically, FIGS. 14A-14C show a spray range of the water flow sprayed from the middle nozzle 610*b*, 610*e* and the lower nozzle 610*c*, 610*d* which spray water into the drum 32 as the circulation pump motor 92 rotates. In this case, the upper nozzle 610*a* may be a direct water nozzle 42 which is not connected to the circulation pump motor 92 but allows the water introduced through the water supply valve 94 to flow into the drum 32.

When the drum 32 viewed from the side is divided into three equal parts to define a first area, a second area, and a third area in order from the front, as the rotation speed of the circulation pump motor 92 gradually increases, it can be seen that the water flow sprayed from the nozzle 610*b*, 610*c*, 610*d*, 610*e* reaches a deeper position of the drum 32.

For example, referring to FIGS. 14A and 14B, when the rotation speed of the circulation pump motor 92 is 1300 rpm, the water flow sprayed from the nozzle 610*b*, 610*c*, 610*d*, 610*e* reaches the side surface portion 321 of the drum 32 within the first area. When the rotation speed of the circulation pump motor 92 is 2000 rpm, the water flow sprayed from the middle nozzles 610*b* and 610*e* reaches the second area, the water flow sprayed from the lower nozzle 610*c*, 610*d* reaches the third area. In the case of S2300 RPM, the water flow sprayed from the nozzle 610*b*, 610*c*, 610*d*, 610*e* reaches the third area.

Referring to FIG. 14C, when the rotation speed of the circulation pump motor 92 is further increased, water flow reaches the rear surface portion 322 of the drum 32. In the case of 3000 rpm, the water flow reaches ⅓ height(H) of the drum 32. In the case of 3500 rpm, the water flow reaches ⅔ height(H) of the drum 32. When the rotation speed of the circulation pump motor 92 reaches 3500 rpm, the height of the water flow becomes maximum. Due to the structure of the nozzle 610*b*, 610*c*, 610*d*, 610*e*, the spray height is no longer increased beyond the maximum, and only the intensity of the water flow can be strengthened.

Meanwhile, the rotation speed value Rpm of the circulation pump motor 92 in FIGS. 14A-14C is a value obtained according to an embodiment of the present disclosure, and may vary depending on the size and shape of the water supply pipe, and the specification of the pump. However, as the rotation speed of the circulation pump motor 92 is increased as shown in FIGS. 14A-14C, the tendency that the water flow reaches close the upper side of the rear surface portion 322 from the front portion of the drum 32 may be the same.

Hereinafter, a method of controlling a washing machine according to an embodiment of the present disclosure will be described with reference to FIG. 15.

Figure 15:
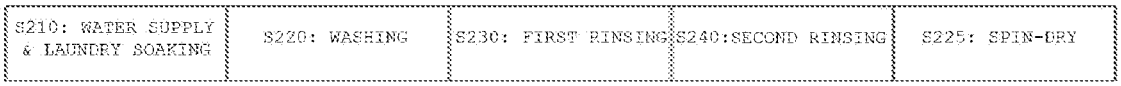
FIG. 15 is a view showing an entire process of a control method of a washing machine according to an embodiment of the present disclosure.
Figure 16A:
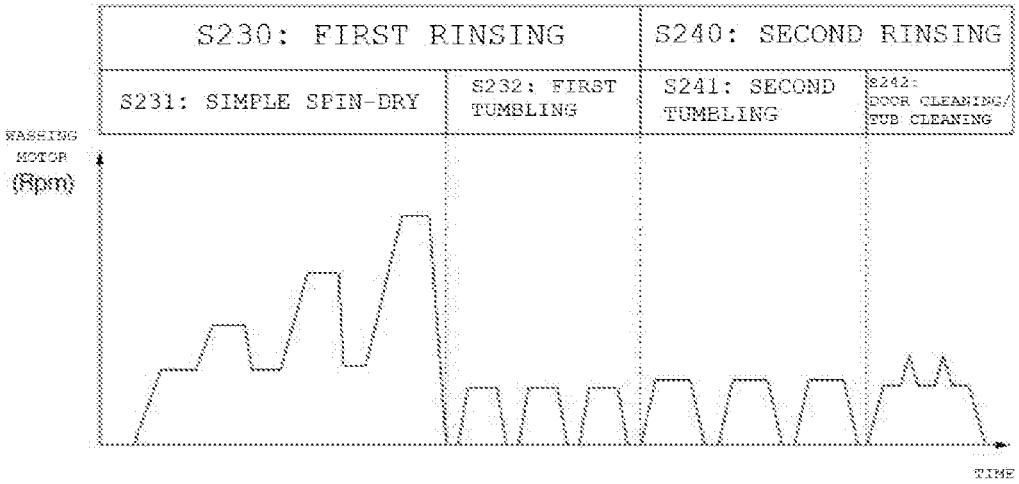
FIGS. 16A and 16B are views showing examples of a rinsing process in a control method of a washing machine according to an embodiment of the present disclosure.
Figure 16B:
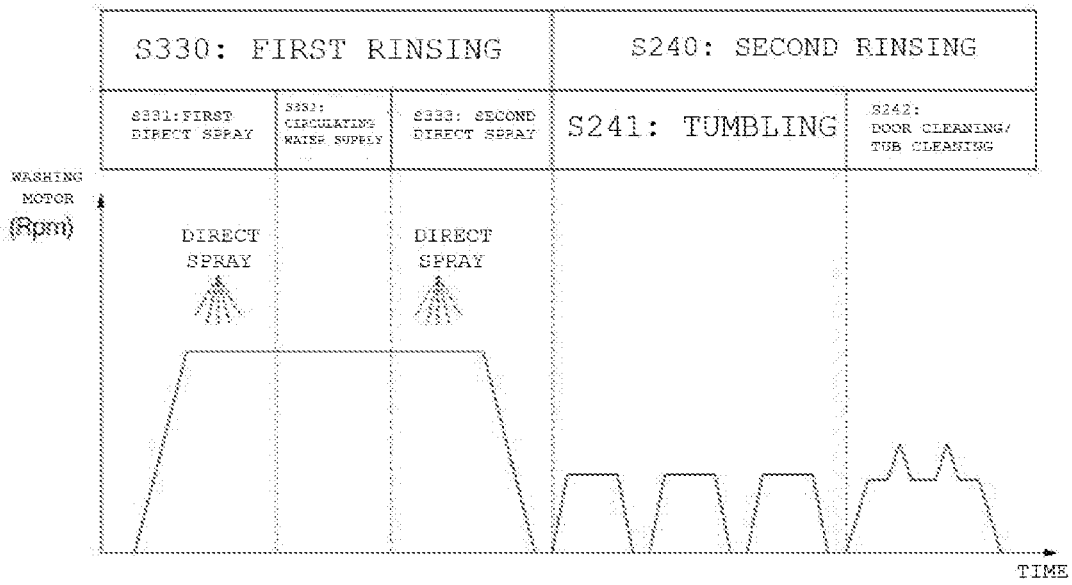

FIG. 15 is a view showing an entire process of a control method of a washing machine according to an embodiment of the present disclosure. FIGS. 16A and 16B are views showing examples of a rinsing process in a control method of a washing machine according to an embodiment of the present disclosure.

As shown in FIG. 15, the washing machine may be configured to sequentially perform water supply/laundry soaking operation (S210), washing operation (S220), first rinsing operation (S230), second rinsing operation (S240), and spin-dry operation (S250).

The water supply/laundry soaking operation (S210) is a process of soaking laundry by supplying water together with a detergent. More specifically, the water supply/laundry soaking operation (S210) may include a detergent dissolution operation and a laundry soaking operation.

In the detergent dissolution operation, the controller 91 may control the water supply valve 94 so that the detergent-dissolved water is supplied into the tub 31.

In the laundry soaking operation, the controller 91 may control the water supply valve 94 so that water is additionally supplied into the tub 31. It is possible to detect the amount of laundry during the water supply.

Meanwhile, in the water supply/laundry soaking operation (S210), step motion and filtration motion may be performed.

The step motion is a motion that is controlled to cause the laundry in the inner circumferential surface of the drum to fall toward the lowest point of the drum 32 from a position near the highest point of the drum 32 while the washing motor 38*b* rotates (preferably, less than one rotation) the drum 32 in one direction. The height to which the laundry rises while being attached to the drum 32 ranges about 146 to 161 degrees in the rotation direction of the drum 32, but is not necessarily limited thereto, and may be greater than 161 degrees within a range of not exceeding 180 degrees.

The filtration motion is a drum driving motion in which the washing motor 38*b* rotates the drum 32 at a high speed so that the laundry is not separated from the side surface portion 321 of the drum 32 due to the centrifugal force. When the filtration motion is performed, the laundry is brought into close contact with the side surface portion 321 due to the centrifugal force, thereby widening the surface area, and washing water can permeate the laundry. Accordingly, when water is sprayed through the nozzle while performing the filtration motion, the laundry can be evenly wetted.

The washing operation (S220) is a step of rotating the drum 32 according to a preset algorithm to remove the contamination on the laundry. Rolling motion and tumbling motion may be performed during the washing operation (S220).

The rolling motion is a motion that is controlled to cause the laundry in the inner circumferential surface of the drum 32 to fall toward the lowest point of the drum 32 from a position of less than about 90 degrees in the rotation direction of the drum 32 while the washing motor 38*b* rotates (preferably, more than one rotation) the drum 32 in one direction.

The tumbling motion is a motion that is controlled to cause the laundry in the inner circumferential surface of the drum 32 to fall toward the lowest point of the drum 32 from a position ranging from about 90 degrees to 110 degrees in the rotation direction of the drum 32 while the washing motor 38*b* rotates (preferably, more than one rotation) the drum 32 in one direction.

In the washing operation (S220), the drum 32 may be rotated in various speeds and/or directions to apply a mechanical force such as a bending force, a frictional force, or an impact force to the laundry to remove the contamination of the laundry.

The rinsing operation (S230, 5240) is a process of removing the detergent on the cloth, and may perform water supply, and perform the rolling motion and the tumbling motion. The rinsing operation (S230, 5240) may include a step of discharging the washing water contained in the tub 31.

The rinsing operation (S230, 5240) may include a step in which the washing water contaminated by the foreign matter separated from the laundry is drained from the tub 31 and the washing water in which the detergent is not dissolved is supplied into the tub 31.

A first rinsing operation (S230) and a second rinsing operation (S240) are processes of removing the residual detergent of the laundry by rotating the drum 32 after wetting the laundry with water. The fabric softener may be added to the laundry together with the water during the first rinsing operation (S230) and/or the second rinsing operation (S240). Depending on embodiments, more than three rinsing operations such as a third rinsing operation or a fourth rinsing operation may be performed.

Referring to FIG. 16A, the first rinsing operation (S230) according to an embodiment of the present disclosure may include a simple spin-dry operation (S231) and a first tumbling operation (S232). The simple spin-dry operation (S231) is a step of rotating the drum 32 at a high speed so as to allow the water wetted in the laundry to escape, and may be different from the (main) spin-dry operation (S250) in the timing, the time of performing the process, or the rotation speed of the drum 32. In the simple spin-dry operation (S231), when the drum 32 is rotated at a high speed, the laundry rotates while being attached to the inner circumferential surface of the drum 32, so that the laundry can be dehydrated due to the centrifugal force.

At the beginning of the rinsing operation (S230, S240), the simple spin-dry operation (S231) may be performed to drain the washing water contaminated with the foreign matter and the washing water having no dissolved detergent may be supplied into the tub 31, thereby improving the rinsing effect of the laundry.

In the first tumbling operation (S232), the above-described tumbling motion may be performed a plurality of times. In the tumbling (S232) process, the controller 91 may control the washing motor 38*b* to perform the tumbling motion, and may accelerate or decelerate the pump motor 92 in response to the acceleration or deceleration of the washing motor 38*b*. Accordingly, the water flow sprayed from the plurality of nozzles 610*a*, 610*b*, 610*c*, 610*d*, and 610*d* may follow the laundry moving in the drum 32.

The second rinsing operation (S240) may include a second tumbling operation (S241) and a door/tub cleaning (S242). The description of the first tumbling operation (S232) may be applied to the second tumbling operation (S241).

The door/tub cleaning (S242) is a step of cleaning the rear surface of the door 20 or the window 22 with water sprayed from at least one of the plurality of nozzles 610*a*, 610*b*, 610*c*, 610*d* and 610*e*, and cleaning the drum 32 and the tub 31 by rotating the water contained in the tub 31.

It is preferable that the door/tub cleaning (S242) is performed after the washing operation (S220), or is performed in the last step of the rinsing operation (S230, S240). That is, the door/tub cleaning operation (S242) may be performed after the washing water having no dissolved detergent is finally supplied into the tub 31. Thus, it is possible to prevent the door 20 or the tub 31 from being contaminated by another rinsing after the door/tub cleaning operation (S242). A detailed description of the door/tub cleaning operation (S242) will be described later with reference to FIGS. 17A and 17B and the following drawings.

Meanwhile, referring to FIG. 16B, the first rinsing operation (S330) according to another embodiment of the present disclosure may include a first direct spray operation (S331), a circulating water supply operation (S332), and a second direct spray operation (S333).

In the first rinsing operation (S330), the washing motor 38*b* may rotate at a high speed such that the centrifugal force applied to the laundry due to the rotation of the drum 32 becomes 1 G or more. That is, even if the laundry in the drum 32 reaches the highest point of the drum 32 while being attached to the inner circumferential surface (or the inner surface of the side surface portion 321) of the drum 32 due to the rotation of the drum 32, the drum 32 may be rotated at a rotation speed equal to or higher than the rotation speed (hereinafter, referred to as "laundry attachment speed") of the drum 32 at the time when the laundry starts not to be separated from the drum 32. That is, the washing motor 38*b* may rotate the drum 32 at a rotation speed at which the acceleration of the material point on the inner circumferential surface (or the inner surface of the side surface portion 321) of the drum 32 becomes equal to or higher than the gravitational acceleration. For example, the washing motor 38*b* may be rotated at 108 Rpm or more, preferably, 150 Rpm or more.

The washing motor 38*b* is accelerated to a preset rotation speed and then rotated while maintaining the set rotation speed for a preset time. The washing motor 38*b* may be braked after the set time.

The first direct water spray operation (S331) may include a step of supplying water supplied from an external water source into the tub 31 through the direct water nozzle (or the upper nozzle 610*a*). The first direct water spray operation (S331) may include a step of controlling the drainage pump so that the water contained in the tub 31 is discharged.

The controller 91 may control the water supply valve 94 so that the water supplied from the external water source is supplied into the tub 31, and control the drainage valve 96 to discharge the water contained in the tub 31.

The circulating water supply operation (S332) may include a step of controlling the pump motor 92 to spray water through at least one nozzle 610*b*, 610*c*, 610*d*, and 610*e*.

The controller 91 may control the pump motor 920 so that water is sprayed through at least one nozzle 610*b*, 610*c*, 610*d*, 610*e*, and may control the drainage valve 96 to be closed so that water is not discharged from the tub 31.

In the second direct spray operation (S333), the controller 91 may control the water supply valve 94 and the drainage valve 96 as in the first direct spray operation (S331). The description of the first direct spray operation (S331) may be applied to the second direct spray operation (S333).

The spin-dry operation (S250) is a step of finally dehydrating the laundry by rotating the drum 32 at a high speed. The spin-dry operation (S250) may include a drainage operation for discharging the water contained in the tub 31 to the outside of the casing 10, a laundry dispersion operation for dispersing laundry by repeating acceleration and deceleration of the drum 32, and a final spin-dry operation for dehydrating the laundry by rotating the drum 32 at a high speed. The maximum rotation speed of the drum in the final spin-dry operation may be set to be higher than the maximum rotation speed of the drum 32 in the simple spin-dry operation (S231). In spin-dry operation (S250), the above-described filtration motion may be performed.

Figure 17A:
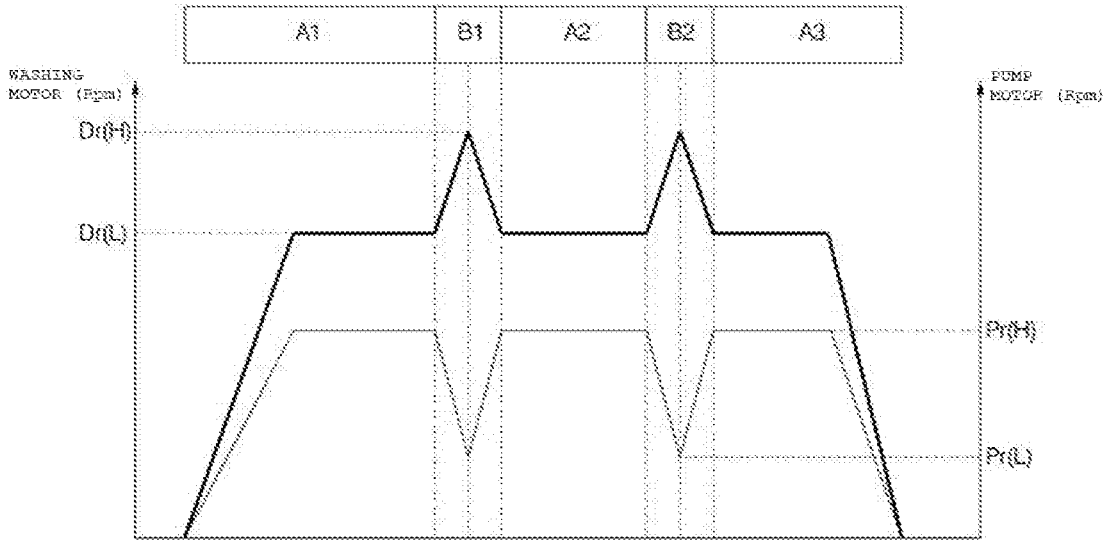
FIG. 17A and FIG. 17B are views showing changes of the rotation speed of a washing motor and a pump motor in door/tub cleaning (S240) processes of a control method of a washing machine according to embodiments of the present disclosure.
Figure 17B:
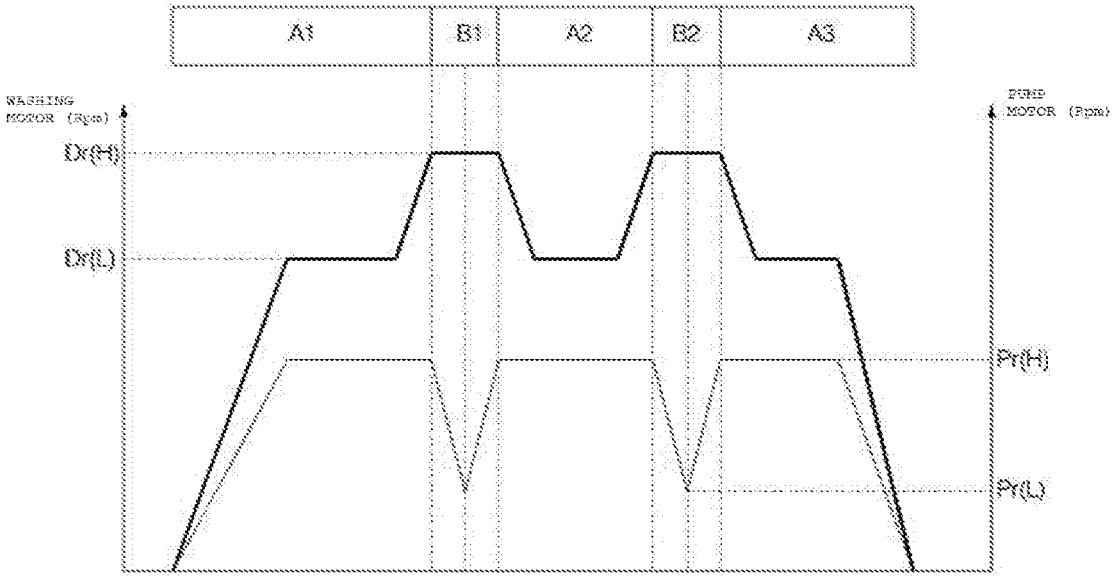

FIG. 17A and FIG. 17B are views showing changes of the rotation speed of the washing motor 38*b* and the pump motor 92 in the door/tub cleaning processes of a control method of a washing machine according to embodiments of the present disclosure.

Although not otherwise described below, it can be understood that the washing motor 38*b* and the pump motor 92 are accelerated, decelerated, or braked by the controller 91.

Referring to FIG. 17A, the washing motor 38*b* may rotate the drum 32 while accommodating the laundry. The washing motor 38*b* may be accelerated to reach a lower limit Dr(L) of a preset rotation speed range. The washing motor 38*b* rotates the drum 32 in one direction for a preset time at a rotation speed Dr(L) at which the laundry rises to a certain height while being attached to the side surface portion 321 of the drum 32.

The washing motor 38*b* may be accelerated to an upper limit Dr(H) of a preset rotation speed, after rotating for a preset time at a lower limit Dr(L) of a preset rotation speed range. The washing motor 38*b* may be decelerated to a lower limit Dr(L) of a preset rotation speed again, after reaching the upper limit Dr(H) of the preset rotation speed.

Thereafter, the washing motor 38*b* may rotate the drum 32 in one direction for a set time at a lower limit Dr (L) of a preset rotation speed.

The rotation speed range of the washing motor 38*b* may be set to between a third rotation speed at which the laundry rises to a certain height and then drops while being attached to the side surface portion 321 of the drum 32 and a fourth rotation speed at which the laundry rotates while being in contact with the side surface portion 321 of the drum 32. The third rotation speed may be set to, e.g., 46 rpm as the drum rotation speed of the tumbling motion. The fourth rotation speed is a minimum rotation speed at which the water accommodated in the tub 31 can reach the entire front surface of the tub 31, and the upper limit value is a maximum value considering the load of the driving unit 38 and the foam overflow through an air vent 31*a*. The fourth rotation speed may be set to 150 rpm.

The washing motor 38*b* may repeat the process of accelerating and decelerating within a preset rotation speed range as many times during a section ranging from a point of accelerating the washing motor to a point of braking.

According to the control method of the washing machine configured as above, the water in the tub 31 may be rotated together with the drum 32 and the tub 31 may be cleaned.

The pump motor may be rotated at the first rotation speed Pr(H) to spray water through at least one nozzle 610*a*, 610*b*, 610*c*, 610*d*, 610*e*. The pump motor may be accelerated to reach the first rotation speed Pr(H) which is the upper limit of the preset rotation speed range. The pump motor may reach the first rotation speed Pr (H) and then maintain for a certain time. For example, the first rotation speed Pr(H) may be set to about 3500 rpm at which the water flow sprayed from the middle nozzle 610*b*, 610*e* reaches the rear surface portion 322 of the drum 32.

Meanwhile, the first rotation speed Pr(H) may be set based on the amount of the laundry contained in the drum 32. For example, the first rotation speed Pr(H) may be set to be higher as the amount of the laundry is larger, so that the water sprayed from the nozzle 610*b*, 610*c*, 610*d*, 610*e* may be sprayed toward the laundry.

The pump motor may rotate at a second rotation speed Pr(L) so that the water flow sprayed from at least one of the plurality of nozzles 610*b*, 610*c*, 610*d*, and 610*e* reaches the inner surface of the door 20 (or the inner surface of the window 22). The second rotation speed Pr(L) may be a lower limit of the preset rotation speed of pump motor. For example, the second rotation speed Pr(L) may be set to about 1500 rpm at which the water flow sprayed from the middle nozzle 610*b*, 610*e* reaches the inner surface of the window 22 of the door 20.

The pump motor may be accelerated again to the first rotation speed Pr(H), after reaching the second rotation speed Pr(L).

Referring to FIG. 17A, the controller may provide a control signal to the pump motor to immediately start acceleration again when reaching the second rotation speed Pr(L).

Alternatively, although not shown, the controller may provide a control signal to the pump motor so that the pump motor starts acceleration when a certain time elapses after reaching the second rotation speed Pr(L).

The pump motor may be decelerated or accelerated within a preset rotation speed range with acceleration within a preset value. That is, the magnitude of the rotation acceleration of the pump motor may be set within a preset value.

Accordingly, the water flow sprayed from at least a part of the plurality of nozzles 610*b*, 610*c*, 610*d*, and 610*e* is uniformly sprayed toward the inner surface of the door 20, thereby effectively cleaning the door. In the present embodiment, the water flow sprayed from the pair of middle nozzles 610*b* and 610*e* may clean the inside surface of the window 22 up and down.

The pump motor may perform the process of decelerating from the first rotation speed Pr(H) to the second rotation speed Pr(L) and accelerating again to the first rotation speed Pr(H) multiple times, until the pump motor starts to accelerate and is braked. Thus, the cleaning effect of the inner surface of the door 20 (or the inner surface of the window 22) may be improved.

Meanwhile, in at least one of a step of rotating the pump motor 92 at the first rotation speed Pr(H) or a step of decelerating and accelerating the pump motor 92, the washing motor 38*b* may control the drum 32 to accelerate and decelerate within a preset rotation speed range. That is, the cleaning of the tub by controlling the rotation speed of the washing motor 38*b* and the cleaning of the door by controlling the rotation speed of the pump motor may be performed individually.

Alternatively, a section in which the rotation speed of the washing motor 38*b* is variable and a section in which the rotation speed of the pump motor is variable may be set overlapped with each other.

Referring to FIG. 17A, the door/tub cleaning (S240) process may include a step A in which the washing motor 38*b* rotates at a third rotation speed Dr(H) and the pump motor rotates at the first rotation speed Pr(H), and a step B in which the pump motor is decelerated to the second rotation speed Pr(L) and then is accelerated again to the first rotation speed Pr(H). In the door/tub cleaning (S240), steps A and B may be repeated several times. At this time, the step A may be divided into A1, A2, A3, and the like according to a temporal order, and the step B may be divided into B1, B2, and the like according to a temporal order.

In the step A1, the washing motor 38*b* is accelerated to the third rotation speed Dr(H), and the pump motor 92 is accelerated to the first rotation speed Pr(H) in response to the acceleration of the washing motor 38*b*. In the step A1, the washing motor 38*b* rotates for a time set to the third rotation speed Dr(H), and the pump motor 92 rotates for a time set to the first rotation speed Pr(H).

The controller 91 may control the pump motor 92 to accelerate in response to the acceleration of the washing motor 38*b*. That is, the controller 91 may provide a control signal to start the acceleration of the pump motor 92 when the washing motor 38*b* starts acceleration.

The rotation speed of the washing motor 38*b* may also be varied in the B1 and B2 sections where the pump motor 92 varies within a preset rotation speed range. The washing motor 92 may vary in time earlier than the B1 or B2 section or may vary after the B1 or B2 section is started, but the rotation speed of the washing motor 38*b* may vary in at least a part of the B1 or B2 section.

When the pump motor 92 reaches the second rotation speed Pr(L) (Pt1, Pt2), the washing motor 38*b* also reaches the fourth rotation speed Dr (H)) which is an upper limit of the preset rotation speed range. That is, when the pump motor 92 reaches a lower limit Pr(H) of the preset rotation speed range and starts the acceleration (Pt1, Pt2), the controller 91 provides a control signal to start the deceleration of the washing motor 38*b*.

In the step A2, the washing motor 38*b* may rotate again for a time set to the third rotation speed Dr(H), and the pump motor 92 may rotate for a time set to the first rotation speed Pr(H).

The washing motor 38*b* and the pump motor 92 may repeatedly perform a step of rotating at a certain speed respectively and a step of varying within a preset rotational speed range respectively several times during a section from the time when the washing motor 38*b* and the pump motor 92 accelerate in a stop state to the time when being braked.

When the control method of the washing machine configured as described above is used, the foreign matter introduced into the drum due to the door cleaning is effectively discharged to the tub outside the drum while the drum is rotated at a high speed so as to clean the tub, thereby preventing the foreign matter attached to the door from contaminating the laundry. In addition, the sound generated when the drum rotates to clean the tub and the water flow sprayed close to the door to clean the door are harmonized visually and audibly so that the user can feel harmoniously.

Meanwhile, referring to FIG. 17B, in the control method of the washing machine according to another embodiment of the present disclosure, the washing motor 38*b* may maintain the rotation speed Dr(H) for a set time after reaching the upper limit Dr(H) of the preset rotation speed range. Thus, the tub cleaning of the front surface of the tub 31 may be performed more effectively.

Figure 18A:
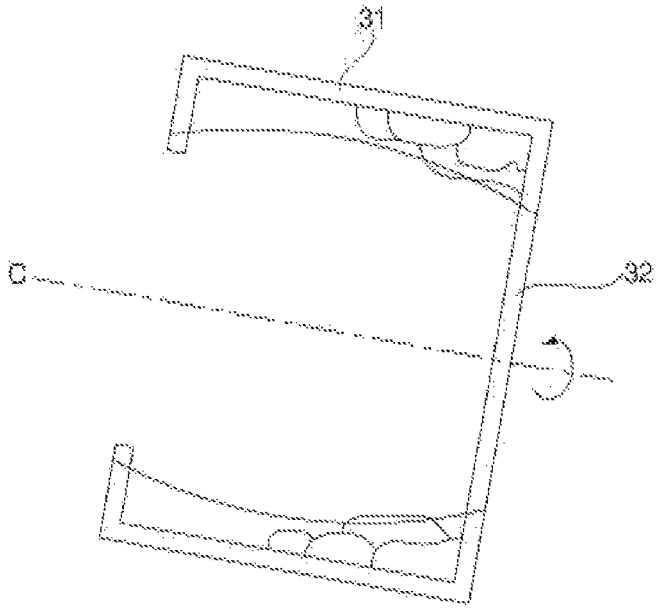
FIGS. 18A and 18B are views showing example flow of water inside a tub in the door/tub cleaning processes shown in FIG. 17A and FIG. 17B.
Figure 18B:
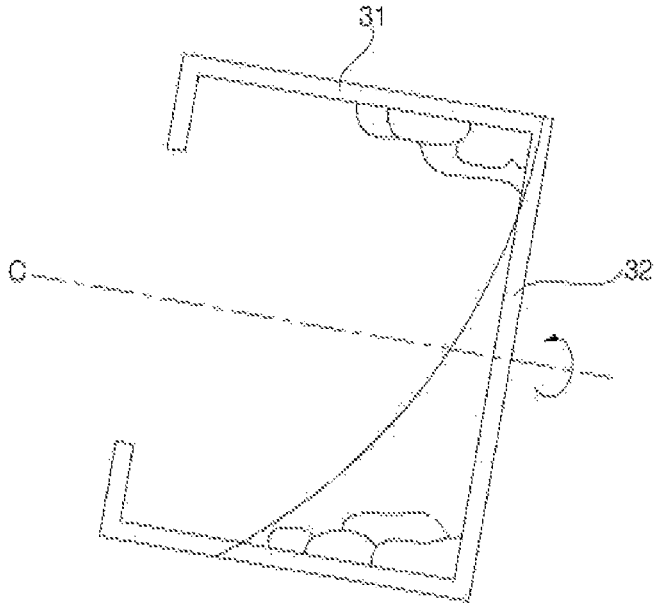

FIGS. 18A and 18B are views showing examples of flow of water inside a tub in the door/tub cleaning processes shown in FIG. 17A and FIG. 17B. Hereinafter, the operation effect of the control method of the washing machine according to the embodiment of the present disclosure will be described with reference to FIGS. 9, 10A-10D, and 18A-18B.

FIGS. 9 and 10A-10D are, as described above with reference to drawings, views showing the water flow sprayed when the spray pressure from the pair of middle nozzles 610*b* and 610*e* is set to the maximum (the upper limit of the set rotation speed of pump motor).

When the control method of the washing machine including the door/tub cleaning (S240) process described with reference to FIGS. 17A and 17B is performed, the water flow sprayed from the pair of middle nozzles 610*b* and 610*e* is sprayed closer to the window 22.

Referring to FIGS. 10A-10D, when the controller 91 controls the circulation pump motor 92 to the lower limit of the preset rotation speed, the water flow sprayed from the pair of middle nozzles 610*b* and 610*e* is oriented to the protruded portion of the window 22 so that the window 22 is cleaned.

Meanwhile, referring to FIG. 9, the pair of middle nozzles 610*b* and 610*e* are configured to be bilaterally symmetrical, so that the middle nozzle 610*b* disposed in the left side sprays water toward the right side and the middle nozzle 610*e* disposed in the right side sprays water toward the left side.

Therefore, in the pair of middle nozzles 610*b* and 610*e*, even when cleaning the window 22, the middle nozzle 610*b* disposed in the left side may clean the window 22 from the left side to the right side, and the middle nozzle 610*e* disposed in the right side may clean the window 22 from the right side to the left side.

The window 22 is protruded rearward toward the drum 32. The detergent or foreign matter adhered to the laundry is left mostly in the upper side surface of the protruded portion. The upper side surface of the window 22 may be effectively cleaned by the pair of middle nozzles 610*b* and 610*e*. That is, most area of the upper side surface of the window 22 may be cleaned with water by using the pair of middle nozzles 610*b* and 610*e*.

The above described control method of the washing machine has an advantage that the circulation nozzle for spraying water into the drum to wash the laundry can be used for cleaning the door. Particularly, the spray for washing and the spray for cleaning the door may be selectively implemented through the control of the speed of the circulation pump (i.e., the speed of the circulation pump motor) for supplying washing water to the circulation nozzle.

In addition, the control method of the washing machine can clean the door with clean washing water having no dissolved detergent by performing the step of cleaning the door during rinsing, and can maintain the door to be clean without requiring a user to clean the door separately even if the washing machine is continuously used. As a result, deterioration of the washing effect due to use of the washing machine can be prevented.

Meanwhile, FIG. 18A shows the water level in the tub when the drum is rotated at the upper limit of the preset rotation speed range, and FIG. 18B shows the water level in the tub when the drum is rotated at the lower limit of the preset rotation speed range.

When the drum 32 is rotated at a high speed (i.e., when the drum 32 is rotated at a speed of the laundry attachment speed or more) in the door/tub cleaning (S242) process such that the drum 32 has a centrifugal force of 1 G or more, the water in the tub 31 rotates along with the rotation of the drum 32.

Referring to FIG. 18A, when the rotation speed of the drum 32 is accelerated by a certain speed or more in the door/tub cleaning process, the water accommodated in the tub is brought into close contact with the inner circumferential surface of the tub 31 due to centrifugal force, so that a part of the water comes into contact with the entire front surface of the tub 31. The water accommodated in the tub 31 gradually reaches the front surface of the tub 31 while the drum 32 is accelerated, and eventually water may reach the entire front surface of the tub 31. For example, when the rotation speed of the drum 32 is 150 RPM or more, water may reach the entire front surface of the tub 31.

Referring to FIG. 18B, in the process of increasing the rotation speed of the drum 32 in the door cleaning and tub cleaning processes, the water contained in the tub 31 forms a parabolic surface, and is raised along the rear surface of the tub 31. When the rotation speed of the drum 32 is within a certain speed, the water flow reaches the entire rear surface of the tub 31. For example, if the rotation speed of the drum 32 ranges from 108 RPM to 150 RPM (e.g., 130 RPM), a part of the water accommodated in the tub 31 may cover the entire rear surface of the tub 31. Thus, the front, rear, and side surfaces of the tub 31 may be evenly cleaned.

Although the exemplary embodiments of the present disclosure have been disclosed for illustrative purposes, those skilled in the art will appreciate that various modifications, additions and substitutions are possible, without departing from the scope and spirit of the disclosure as disclosed in the accompanying claims. Accordingly, the scope of the present disclosure is not construed as being limited to the described embodiments but is defined by the appended claims as well as equivalents thereto.

What is claimed is:

1. A method of controlling a washing machine that includes a casing that defines an input port configured to receive laundry, a tub disposed in the casing, a drum rotatably disposed in the tub, a door disposed at the casing and configured to open and close the input port, the door including a window configured to protrude into the tub through the input port in a closed state of the input port, a washing motor configured to drive the drum, at least one nozzle disposed vertically above the window and configured to spray water downward into the drum, and a pump configured to circulate water discharged from the tub to the at least one nozzle, the pump including a pump motor configured to vary a speed of the pump motor to control a flow rate of water circulated to the at least one nozzle, the method comprising:

rotating, by controlling the washing motor, the drum in a state in which the tub accommodates water;

during the rotation of the drum, rotating the pump motor at a first pump rotation speed to spray water through the at least one nozzle into the drum without interfering with the window; and during the rotation of the drum, decelerating the pump motor from the first pump rotation speed to a second pump rotation speed to allow water sprayed from the at least one nozzle to be dropped to a portion of the window protruding into the tub.

2. The method of claim 1, wherein rotating the drum comprises:

driving the washing motor to rotate the drum at a first drum rotation speed;

accelerating the washing motor from the first drum rotation speed to a second drum rotation speed;

decelerating the washing motor from the second drum rotation speed to the first drum rotation speed; and based on decelerating the washing motor from the second drum rotation speed to the first drum rotation speed, driving the washing motor to rotate the drum at the first drum rotation speed, wherein decelerating the pump motor comprises decelerating the pump motor based on accelerating the washing motor from the first drum rotation speed to the second drum rotation speed.

3. The method of claim 2, further comprising:

accelerating the pump motor from the second pump rotation speed to the first pump rotation speed in response to decelerating the washing motor from the second drum rotation speed to the first drum rotation speed.

4. The method of claim 3, wherein rotating the drum further comprises repeating a rotation of the drum a plurality of times, and wherein the method further comprises:

in response to repeating the rotation of the drum the plurality of times, repeating, a plurality of times, (i) a deceleration of the pump motor from the first pump rotation speed to the second pump rotation speed and (ii) an acceleration of the pump motor from the second pump rotation speed to the first pump rotation speed.

5. The method of claim 1, wherein rotating the drum comprises:

driving the washing motor to rotate the drum at a first drum rotation speed;

accelerating the washing motor from the first drum rotation speed to a second drum rotation speed;

based on accelerating the washing motor from the first drum rotation speed to the second drum rotation speed, driving the washing motor to rotate the drum at the second drum rotation speed;

decelerating the washing motor from the second drum rotation speed to the first drum rotation speed; and based on decelerating the washing motor from the second drum rotation speed to the first drum rotation speed, driving the washing motor to rotate the drum at the first drum rotation speed, wherein decelerating the pump motor comprises decelerating the pump motor based on driving the washing motor to rotate the drum at the second drum rotation speed.

6. The method of claim 5, wherein decelerating the pump motor further comprises decelerating the pump motor based on the washing motor being accelerated from the first drum rotation speed to the second drum rotation speed.

7. The method of claim 6, wherein decelerating the washing motor comprises:

based on the pump motor being accelerated from the second pump rotation speed to the first pump rotation speed, decelerating the washing motor from the second drum rotation speed to the first drum rotation speed.

8. The method of claim 7, wherein rotating the drum comprises repeating a rotation of the drum a plurality of times, and wherein the method further comprises:

in response to repeating the rotation of the drum the plurality of times, repeating, a plurality of times, (i) a deceleration of the pump motor from the first pump rotation speed to the second pump rotation speed and (ii) an acceleration from the second pump rotation speed to the first pump rotation speed.

9. The method of claim 1, wherein the at least one nozzle is disposed forward of the drum, and wherein rotating the pump motor comprises spraying water rearward from the at least one nozzle toward the drum.

10. The method of claim 1, wherein rotating the drum comprises:

driving the washing motor to rotate the drum in one direction to cause laundry in the drum (i) to be raised to a height relative to a bottom of the drum along an inner circumferential surface of the drum and (ii) then to be dropped from the inner circumferential surface of the drum.

11. The method of claim 2, wherein the first drum rotation speed is set in a range of speed to cause laundry in the drum to be raised to a height with respect to a bottom of the drum along an inner circumferential surface of the drum and then to be dropped from the inner circumferential surface of the drum, and wherein the second drum rotation speed is greater than or equal to a threshold speed to allow laundry in the drum to remain in contact with a highest point of the drum relative to the bottom of the drum while being raised to the highest point of the drum along the inner circumferential surface of the drum by rotation of the drum.

12. The method of claim 1, further comprising:

draining washing water from the tub and supplying washing water to reduce detergent dissolved in washing water in the tub, wherein rotating the drum comprises rotating the drum after draining washing water and supplying washing water.

13. The method of claim 12, wherein draining washing water and supplying washing water comprise repeating, a plurality of times, (i) draining washing water from the tub and (ii) supplying washing water to the tub, and wherein rotating the drum comprises rotating the drum after supplying washing water at a final time among the plurality of times in which detergent is no longer dissolved in washing water supplied into the tub.

14. The method of claim 12, further comprising rinsing laundry, wherein rinsing laundry comprises:

accelerating the drum to reduce water absorbed in laundry;

draining washing water in the tub; and supplying washing water having no dissolved detergent into the tub, and wherein rotating the drum comprises rotating the drum after rinsing laundry.

15. The method of claim 14, wherein rinsing laundry further comprises:

rotating, by controlling the washing motor, the drum at a rinse speed to allow laundry in the drum to remain in contact with a highest point of the drum relative to a bottom of the drum while being raised to the highest point of the drum along an inner circumferential surface of the drum by rotation of the drum; and based on rotating the drum at the rinse speed, supplying washing water having no dissolved detergent into the tub.

16. The method of claim 15, wherein rinsing laundry further comprises:

discharging water in the tub based on rotating the drum at the rinse speed.

17. The method of claim 15, wherein rinsing laundry further comprises:

rotating, by controlling the washing motor, the drum at a speed greater than the rinse speed; and based on rotating the drum at the speed above the rinse speed, controlling the pump motor to spray water through the at least one nozzle.

18. The method of claim 1, further comprising detecting a laundry amount in the drum, wherein rotating the drum comprises rotating the drum at a first drum rotation speed that is set based on the detected laundry amount.

19. A washing machine comprising:

a casing that defines an input port configured to receive laundry;

a tub disposed in the casing and configured to accommodate water;

a drum rotatably disposed in the tub and configured to accommodate laundry;

a door disposed at the casing and configured to open and close the input port, the door comprising a window configured to protrude into the tub through the input port in a closed state of the input port;

a washing motor configured to drive the drum;

at least one nozzle disposed vertically above the window and configured to spray water downward into the drum;

a pump configured to circulate water discharged from the tub to the at least one nozzle, the pump comprising a pump motor configured to vary a speed of the pump motor to control a flow rate of water circulated to the at least one nozzle; and a controller configured to:

control the washing motor to rotate the drum, control the pump motor to spray water through the at least one nozzle during rotation of the drum, control the pump motor to rotate at a first rotation speed to spray water through the at least one nozzle without interfering with the window, and based on controlling the pump motor to rotate at the first rotation speed, control the pump motor to decelerate from the first rotation speed to a second rotation speed to allow water sprayed from the at least one nozzle to be dropped to a portion of the window protruding into the tub.

20. The washing machine of claim 19, wherein the controller is further configure to:

drive the washing motor to rotate the drum in one direction to cause laundry in the drum (i) to be raised to a height relative to a bottom of the drum along an inner circumferential surface of the drum and (ii) then to be dropped from the inner circumferential surface of the drum.

* * * * *